United States Patent [19]

Matsuura et al.

[11] Patent Number: 4,463,077

[45] Date of Patent: Jul. 31, 1984

[54] ELECTROPHOTOGRAPHIC PHOTOSENSITIVE MATERIAL COMPRISES PYRAZOLINE AND HYDRAZONE DERIVATIVES

[75] Inventors: Kazuo Matsuura, Kusatsu; Keisuke Ohshima, Ootsu, both of Japan

[73] Assignee: Toray Industries, Inc., Tokyo, Japan

[21] Appl. No.: 497,852

[22] Filed: May 25, 1983

[30] Foreign Application Priority Data

May 26, 1982 [JP] Japan ..... 57-88122
Jun. 2, 1982 [JP] Japan ..... 57-92976

[51] Int. Cl.[3] ..... G03G 5/06; G03G 5/14

[52] U.S. Cl. ..... 430/56; 430/57; 430/58; 430/76; 430/83

[58] Field of Search ..... 430/57, 58, 76, 56

[56] References Cited

U.S. PATENT DOCUMENTS 3,859,303 1/1975 Katsuyama et al. ..... 430/76
4,365,014 12/1982 Sakai et al. ..... 430/57
4,367,273 1/1983 Murayama et al. ..... 430/56

*Primary Examiner*—John D. Welsh
*Attorney, Agent, or Firm*—Austin R. Miller

[57] ABSTRACT

An electrophotographic photosensitive material is provided, which has a photosensitive layer formed on an electroconductive substrate and containing a polymeric binder and an organic photoconductor. The organic photoconductor is expressed by the formula:

14 Claims, No Drawings

ELECTROPHOTOGRAPHIC PHOTOSENSITIVE MATERIAL COMPRISES PYRAZOLINE AND HYDRAZONE DERIVATIVES

BACKGROUND OF THE INVENTION (1) Field of the Invention

This invention relates to an electrophotographic photosensitive material. More particularly, it relates to an electrophotographic photosensitive layer containing an organic photoconductor and a polymeric binder.

(2) Description of the Prior Art

Organic photoconductors are advantageous over inorganic photoconductors in that they are light in weight, possess good flexibility, provide photosensitive layers excellent in transparency and can easily be combined into a composite material with other materials. Polyvinyl carbazoles, oxadiazoles and pyrazoline derivatives are known as such organic photoconductors.

Basic properties required for electrophotographic photosensitive materials are high static charge acceptance and high charge retentivity in the dark, a high sensitivity, a low residual voltage, a broad spectral sensitivity in the visible region, a high durability, no toxicity, and good processabilities (including a good film-forming property, a high transparency, a high flexibility and a good adaptability to the mass production. Organic photoconductors and inorganic photoconductors, which are satisfactory in all of these basic properties when they are used alone, have not heretofore been proposed. Thus, photoconductors popularly used at present have some defects or others.

Under this circumstance, function-separated electrophotographic photosensitive materials have recently been proposed. These photosensitive materials are based on the concept that the photosensitive layer is divided into layers differing in the function, that is, a charge generating layer for generating charges on absorption of light and a charge transport layer for transporting the formed charges, whereby the range for the selection of materials is broadened and some or all of the basic properties required for electrophotographic photosensitive materials are sufficiently manifested. Many function-separated electrophotographic photosensitive materials have heretofore been proposed, but only a limited number of them have been put into practical use. The practically used photosensitive materials still have some defects or others.

The combination of a charge generating material and a charge transport material has not theoretically been examined, but various combinations have been examined according to trial-and-error procedures.

The use of pyrazoline and hydrazone derivatives is described in U.S. Pat. No. 3,180,729, U.S. Pat. No. 3,837,851 and U.S. Pat. No. 4,150,987. However, hydrazine used as the starting material in these conventional techniques has a strong toxicity. Furthermore, U.S. Pat. No. 3,066,023 teaches the use of acylhydrazones. However, an electrophotographic photosensitive material comprising an acylhydrazone as the organic photoconductor has a problem such that the sensitivity is low.

SUMMARY OF THE INVENTION

It is therefore a primary object of the present invention to provide an electrophotographic material which is excellent in the charge acceptance and charge retentivity in the dark place and has a high sensitivity as well as a good durability.

Another object of the present invention is to provide an electrophotographic photosensitive material comprising an organic photoconductor obtained from a starting material having a much higher safety than that of the starting material for the known hydrazone and pyrazoline derivatives.

Still another object of the present invention is to provide a photosensitive layer comprising a polymeric binder and an organic photoconductor having an enhanced compatibility with the polymeric binder.

In accordance with the present invention, there is provided an electrophotographic photosensitive material comprising a photosensitive layer formed on an electroconductive substrate, said photosensitive layer containing a polymeric binder and an organic photoconductor represented by the following formula (I):

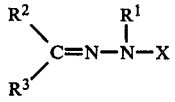

(I)

wherein $R^1$ and $R^2$ either form a pyrazoline ring together with

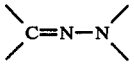

or are not included in the same ring, (i) in the case where $R^1$ and $R^2$ form a pyrazoline ring, $R^1$ is $>CHR^4$ (where $R^4$ is an alkyl group, an aralykyl group, an aryl group or a heterocyclic residue), $R^2$ is $>CH_2$, $R^3$ is $-(CH{=}CH)_nR^5$ (where $R^5$ is an alkyl group, an aralkyl group, an aryl group or a heterocyclic residue), X is

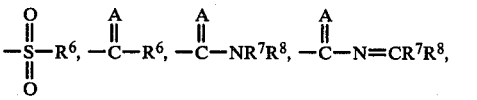

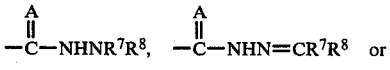

or

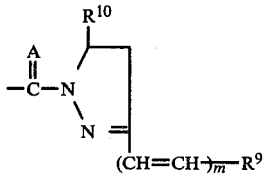

(where n is 0 or 1, m is 0 or 1, A is an oxygen atom or a sulfur atom, $R^6$, $R^9$ and $R^{10}$ independently signify an alkyl group, an aralkyl group, an aryl group or a heterocyclic residue, and, $R^7$ and $R^8$ either form a ring together with the nitrogen or carbon atom to which $R^7$ and $R^8$ are bonded and in this case $R^7$ and $R^8$ independently signify a carbon, nitrogen, oxygen or sulfur atom, or, $R^7$ and $R^8$ are not included in the same ring and in this case $R^7$ and $R^8$ independently signify a hydrogen atom, an alkyl group, an aralkyl group, an aryl group or a heterocyclic residue, (ii) in the case where $R^1$ and $R^2$ are not included in the same ring, $R^1$ is a hydrogen atom, $R^2$ and $R^3$ either form a ring together with the carbon atom to which $R^2$ and $R^3$ are bonded and in this case $R^2$ and $R^3$ independently signify a carbon, nitrogen, oxygen or sulfur atom, or $R^2$ and $R^3$ are not included in the same ring and in this case $R^2$ and $R^3$ independently signify a hydrogen atom, an alkyl group, an aralkyl group, an aryl group, a heterocyclic residue or $$-Y_n-\overset{R^{14}}{\overset{|}{C}}=N-\overset{O}{\overset{\|}{N}}HCR^{15}$$

[where Y is a divalent group selected from alkylene, aralkylene, and arylene groups and heterocyclic residues, n is 0 or 1, $R^{14}$ is a hydrogen atom, an alkyl group, an aralkyl group, an aryl group or a heterocyclic residue, and $R^{15}$ is a alkyl group, an aralkyl group, an aryl group or a heterocyclic residue.]

X is $$-\overset{O}{\overset{\|}{\underset{\underset{O}{\|}}{S}}}-R^{11},\ -\overset{B}{\overset{\|}{C}}-NR^{12}R^{13},\ -\overset{B}{\overset{\|}{C}}-N=CR^{12}R^{13},$$

$$-\overset{B}{\overset{\|}{C}}-NHNR^{12}R^{13},\ \text{or}\ -\overset{B}{\overset{\|}{C}}-NHN=C^{12}R^{13}$$

(where B is an oxygen atom or a sulfur atom, $R^{11}$ is an alkyl group, an aralkyl group, an aryl group or a heterocyclic residue, $R^{12}$ and $R^{13}$ either form a ring together with the nitrogen or carbon atom to which $R^{12}$ and $R^{13}$ are bonded and in this case $R^{12}$ and $R^{13}$ independently signify a carbon, nitrogen, oxygen or sulfur atom, or, $R^{12}$ and $R^{13}$ are not included in the same ring and in this case $R^{12}$ and $R^{13}$ independently signify a hydrogen atom, an alkyl group, an aralkyl group, an aryl group, a heterocyclic residue or $$-Y_n-\overset{R^{14}}{\overset{|}{C}}=N-\overset{O}{\overset{\|}{N}}HCR^{15}$$

where Y, n, $R^{14}$ and $R^{15}$ are the same as defined above)].

In the above general formula (I), $R^1$ through $R^{15}$ may have substituents. As the alkyl and alkylene groups, those having 1 to 12 carbon atoms are preferable. As the aralkyl and aralkylene groups, those having 7 to 14 carbon atoms are preferable. As the aryl and arylene groups, those having 6 to 20 carbon atoms are preferable. As the heterocyclic residue, 3- to 30-membered heterocyclic residues containing nitrogen, oxygen or sulfur as ring constituents are preferable. For example, pyrrole, pyrazole, pyrazoline, imidazole, triazole, pyridine, pyrimidine, pyrazine, triazine, indole, quinoline, quinazoline, phthalazine, carbazole, acridine, phenazine, furan, pyran, benzofuran, thiophene, benzothiophene, oxazole, benzoxazole, oxadiazole, thiazole, benzothiazole, thiazine, thiadiazole, imidazolone and imidazothione can be mentioned. As the substituent, there can be mentioned alkyl groups such as methyl, ehtyl and propyl groups, alkoxy groups such as a methoxy group, halogen atoms such as fluorine, chlorine, bromine and iodine, amino groups such as amino, methylamino, ehtylamino, propylamino, dimethylamino, diethylamino, and benzylamino groups; a hydroxyl group; acyl groups such as an acetyl group; and a thiol group.

DESCRIPTION OF THE PREFERRED EMBODIMENTS

The indispensable ingredients of the photosensitive layer of the present invention, that is, the organic photoconductor represented by the general formula (I) and the polymeric binder, will now be described in detail.

The organic photoconductor represented by the general formula (I) includes the following compounds (1) through (8).

(1) A pyrazoline compound represented by the following general formula (1a), (1b) or (1c) [these are hereinafter referred to as "compound (1)" for brevity]:

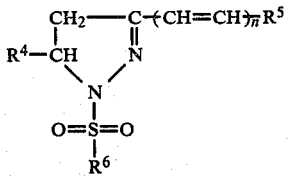

(1a)

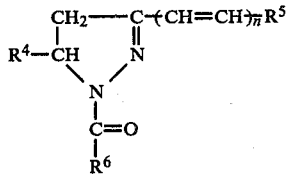

(1b)

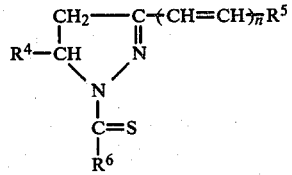

(1c)

wherein n is 0 or 1 and $R^4$, $R^5$ and $R^6$ independently signify an alkyl group, an aralkyl group, an aryl group or a heterocyclic residue.

(2) A pyrazoline compound represented by the following formula (2a) or (2b) [these are hereinafter referred to as "compound (2)" for brevity]:

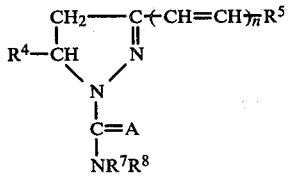

(2a)

-continued

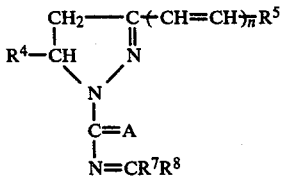

(2b)

wherein n is 0 or 1,

A is an oxygen atom or a sulfur atom, $R^4$ and $R^5$ independently signify an alkyl group, an aralkyl group, an aryl group or a heterocyclic residue, and $R^7$ and $R^8$ either form a ring together with the carbon or nitrogen atom to which $R^7$ and $R^8$ are bonded and in this case $R^7$ and $R^8$ independently signify a carbon, nitrogen, oxygen or sulfur atom, or, $R^7$ and $R^8$ are not included in the same ring and in this case $R^7$ and $R^8$ independently signify a hydrogen atom, an alkyl group, an aralkyl group, an aryl group or a heterocyclic residue.

(3) A pyrazoline compound represented by the following general formula (3a), (3b) or (3c) [these are hereinafter referred to as "compound (3)" for brevity]:

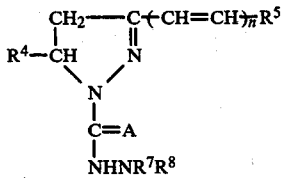

(3a)

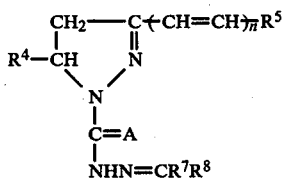

(3b)

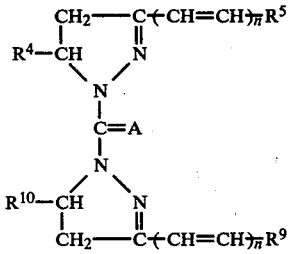

(3c)

wherein n is 0 or 1,

A is an oxygen atom or a sulfur atom, $R^4$, $R^5$, $R^9$ and $R^{10}$ independently signify an alkyl group, an aralkyl group, an aryl group or a heterocyclic residue, and $R^7$ and $R^8$ either form a ring together with the carbon or nitrogen atom to which $R^7$ and $R^8$ are bonded and in this case $R^7$ and $R^8$ independently signify a carbon, nitrogen, oxygen or sulfur atom, or, $R^7$ and $R^8$ are not included in the same ring and in this case $R^7$ and $R^8$ independently signify a hydrogen atom, an alkyl group, an aralkyl group, an aryl group or a heterocyclic residue.

(4) A sulfonylhydrazone compound represented by the following general formula (4a) [hereinafter referred to as "compound (4)" for brevity]:

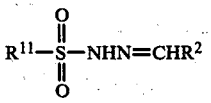

(4a)

wherein $R^2$ and $R^{11}$ independently signify an alkyl group, an aralkyl group, an aryl group or a heterocyclic residue.

(5) A sulfonylhydrazone compound represented by the following general formula (5a) [hereinafter referred to as "compound (5)" for brevity]:

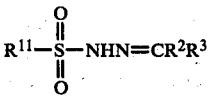

(5a)

wherein $R^2$ and $R^3$ either form a ring together with the carbon atom to which $R^2$ and $R^3$ are bonded and in this case $R^2$ and $R^3$ independently signify a carbon, nitrogen, oxygen or sulfur atom, or, $R^2$ and $R^3$ are not included in the same ring and in this case $R^2$ and $R^3$ independently signify an alkyl group, an aralkyl group, an aryl group or a heterocyclic residue, and $R^{11}$ is an alkyl group, an aralkyl group, an aryl group or a heterocyclic residue.

(6) A sulfonylhydrazone compound represented by the following general formula (6a) [hereinafter referred to as "compound (6)" for brevity]:

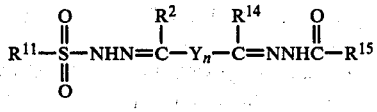

(6a)

wherein $R^{11}$ and $R^{15}$ independently signify an alkyl group, an aralkyl group, an aryl group or a heterocyclic residue, $R^2$ and $R^{14}$ independently signify a hydrogen atom, an alkyl group, an aralkyl group, an aryl group or a heterocyclic residue, Y is a divalent group selected from alkylene groups, aralkylene groups, arylene groups and heterocyclic residues, and n is 0 or 1.

(7) A semicarbazone compound represented by the following general formula (7a) or (7b) [these are hereinafter referred to as "compound (7)" for brevity]:

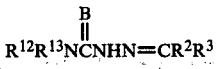

(7a)

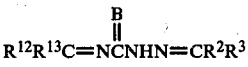

(7b)

wherein

B is an oxygen atom or a sulfur atom, and $R^2$ and $R^3$ either form a ring together with the carbon atom to which $R^2$ and $R^3$ are bonded and in this case $R^2$ and $R^3$ independently signify a carbon, nitrogen, oxygen or sulfur atom, or $R^2$ and $R^3$ are not included in the same ring and in this case $R^2$ and $R^3$ independently signify a hydrogen atom, an alkyl group, an aralkyl group, an aryl group or a heterocyclic residue, and $R^{12}$ and $R^{13}$ are defined as signifying the same groups as those defined with respect to $R^2$ and $R^3$ above.

(8) A carbohydrazone compound represented by the following general formula (8a) or (8b) [these are hereinafter referred to as "compound (8)" for brevity]:

$$R^{13}R^{12}NNH\overset{\overset{B}{\|}}{C}NHN{=}CR^2R^3 \quad (8a)$$

$$R^{13}R^{12}C{=}NNH\overset{\overset{B}{\|}}{C}NHN{=}CR^2R^3 \quad (8b)$$

wherein B, $R^2$, $R^3$, $R^{12}$ and $R^{13}$ signify the same group as those defined with respect compound (7) above.

In the above compounds (1) through (8), $R^1$ and $R^{15}$ may have substituents. As the alkyl and alkylene groups, those having 1 to 12 carbon atoms are preferable. As the aralkyl and aralkylene groups, those having 7 to 14 carbon atoms are preferable. As the aryl and arylene groups, those having 6 to 20 carbon atoms are preferable. As the heterocyclic residue, 3- to 30-membered heterocyclic residues containing nitrogen, oxygen or sulfur as ring constituents are preferable. For example, pyrrole, pyrazole, pyrazoline, imidazole, triazole, pyridine, pyrimidine, pyrazine, triazine, indole, quinoline, quinazoline, phthalazine, carbazole, acridine, phenazine, furan, pyran, benzofuran, thiophene, benzothiophene, thiazine, thiadiazole, imidazolone and imidazothione can be mentioned. As the substituent, there can be mentioned alkyl groups such as methyl, ethyl and propyl groups; alkoxy groups such as a methoxy group; halogen atoms such as fluorine, chlorine, bromine and iodine; amino groups such as amino, methylamino, ehtylamino, propylamino, dimethylamino, diethylamino and benzylamino groups; a hydroxyl group; acyl groups such as acetyl group; and a thiol group.

As examples of the pyrazoline compound (1) represented by the general formula (1a), (1b), or (1c), the following compounds can be mentioned:

(1-1)

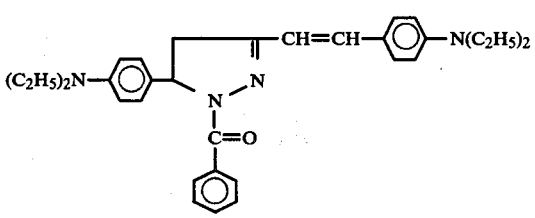

(1-2)

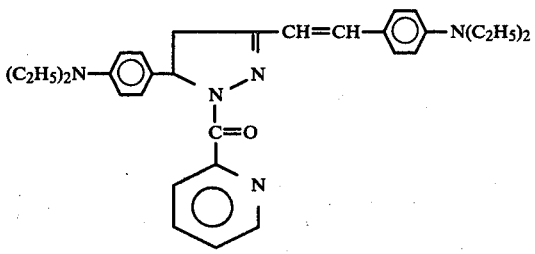

-continued (1-3)

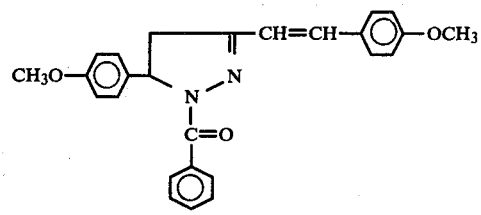

(1-4)

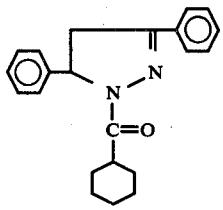

(1-5)

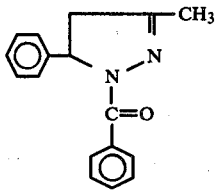

(1-6)

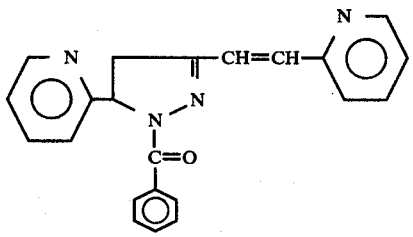

(1-7)

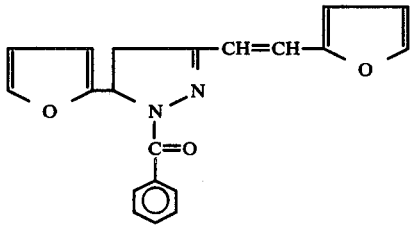

(1-8)

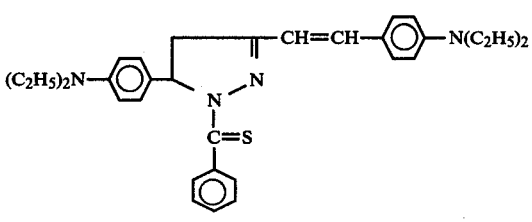

(1-9)

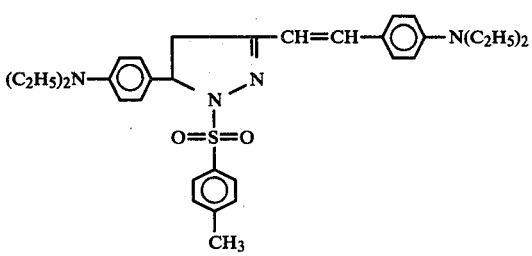

-continued (1-10)

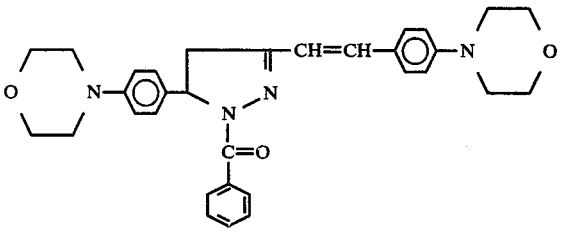

Furthermore, a compound having at least two pyrazoline groups, such as a compound having the following formula:

(1-11)

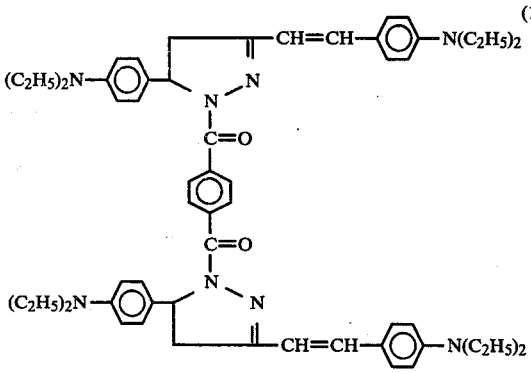

can be used effectively. Of course, compounds that can be used are not limited to those exemplified above. These pyrazoline compounds may be used alone or in the form of mixtures of two or more of them.

The compound (1) may be prepared according to a known method. More specifically, the compound (1) can be obtained by condensing equimolar amounts of a hydrazine compound an an $\alpha,\beta$-unsaturated carbonyl compound in an organic solvent under heating, if necessary, in the presence of an acid such as acetic acid or hydrochloric acid.

As preferred examples of the pyrazoline compound (2) represented by the general formula (2a) or (2b), the following compounds can be mentioned:

(2-1)

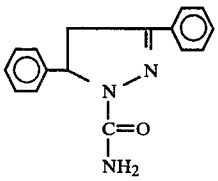

(2-2)

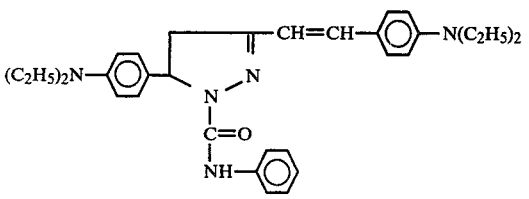

-continued (2-3)

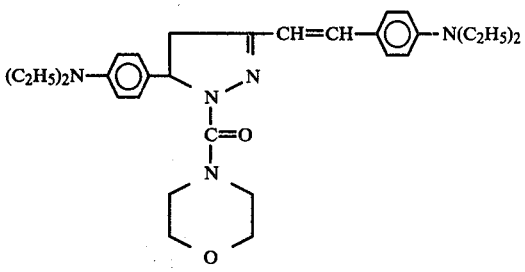

(2-4)

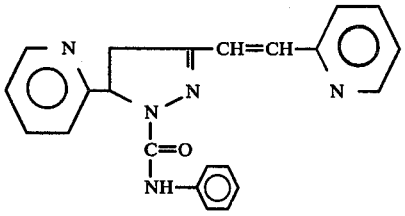

(2-5)

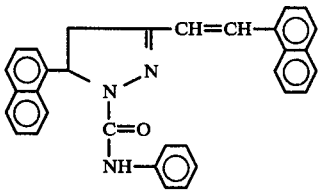

(2-6)

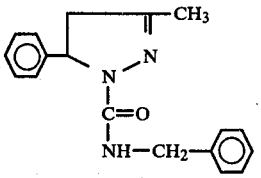

(2-7)

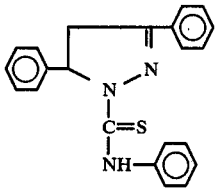

(2-8)

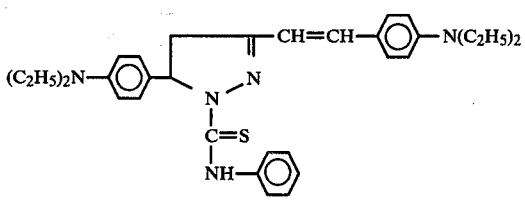

(2-9)

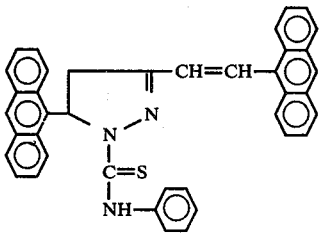

-continued (2-10)

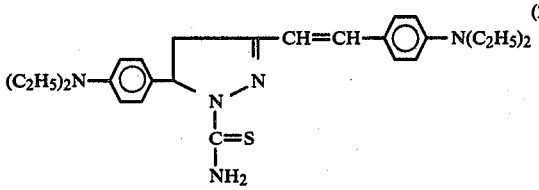

(2-11)

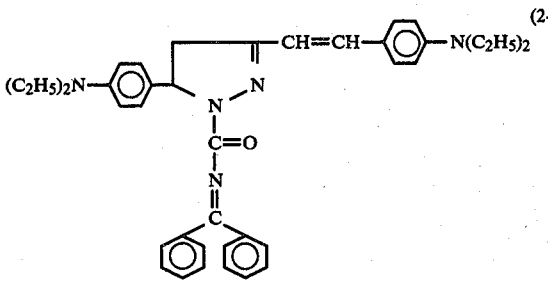

(2-12)

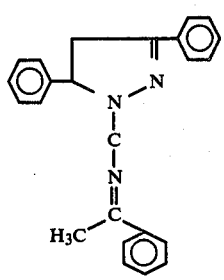

(2-13)

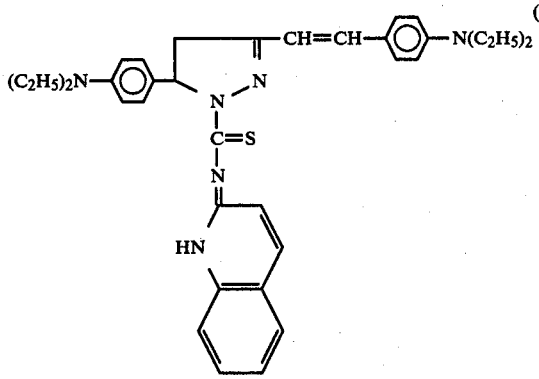

(2-14)

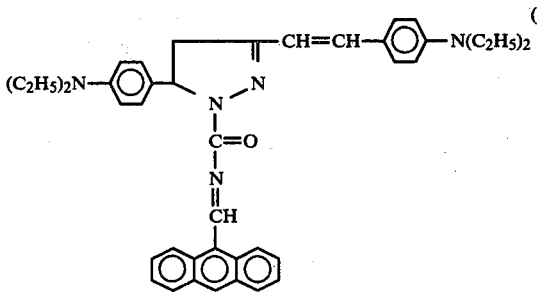

Furthermore, a compound having at least two pyrazoline groups, such as a compound having the following formula:

(2-15)

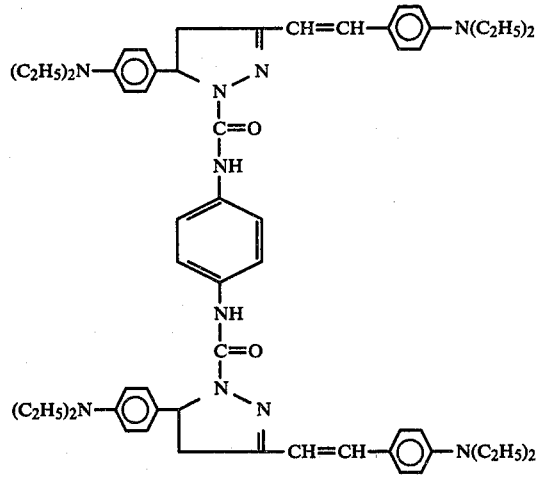

can be used effectively. Of course, compounds that can be used are not limited to those exemplified above. These pyrazoline compounds may be used alone or in the form of mixtures of two or more of them.

The compound (2) may be prepared according to various known methods. For example, a compound (2) of the formula (2a) can be obtained by heating equimolar amounts of a semicarbazide compound and an $\alpha,\beta$-unsaturated carbonyl compound in an organic solvent in the presence of an acid such as acetic acid or hydrochloric acid to effect condensation and ring closure. A compound (2) of the formula (2b) can be obtained by condensing an equimolar amount of a carbonyl compound with the so-obtained compound ($R^7$ and $R^8$ each signifies a hydrogen atom) in an organic solvent under heating, if necessary in the presence of an acid such as acetic acid or hydrochloric acid.

As preferred examples of the pyrazoline compound (3) of the formula (3a), (3b) or (3c), the following compounds can be mentioned:

(3-1)

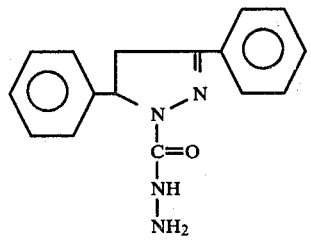

(3-2)

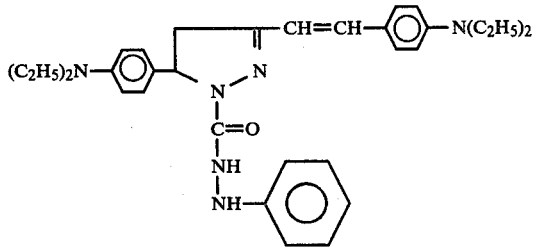

-continued
(3-3)
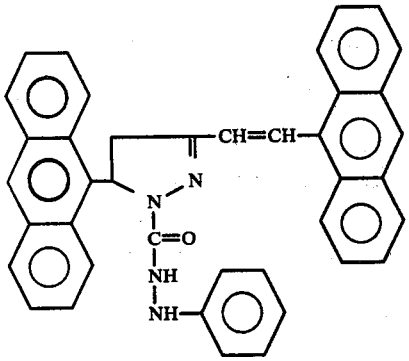
(3-4)
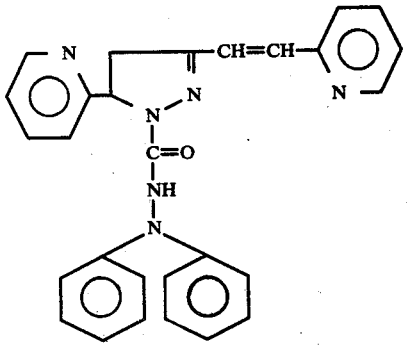
(3-5)
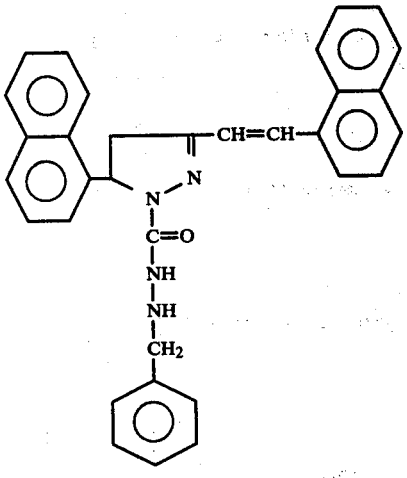
(3-6)
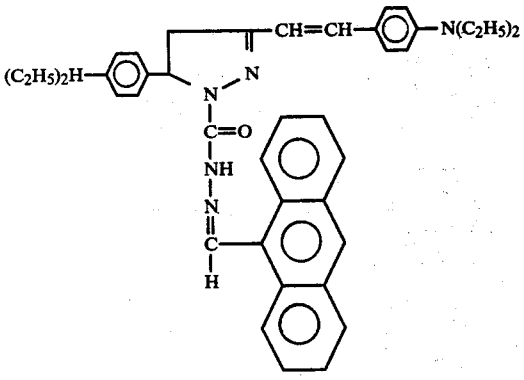
-continued
(3-7)
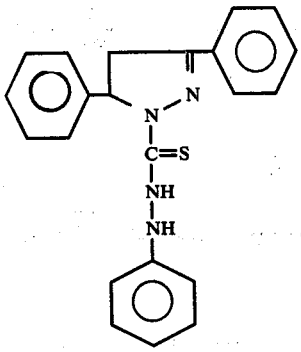
(3-8)
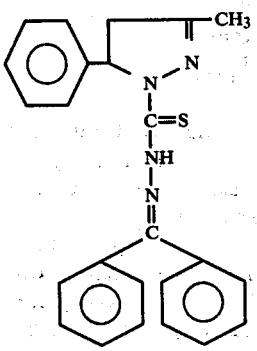
(3-9)
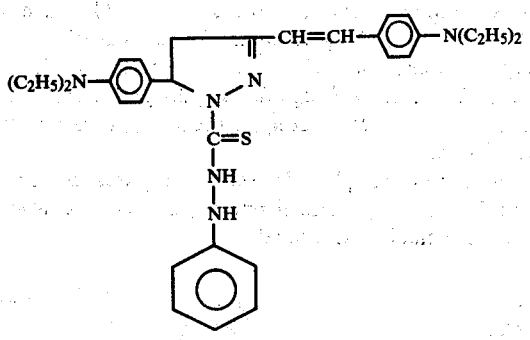
(3-10)
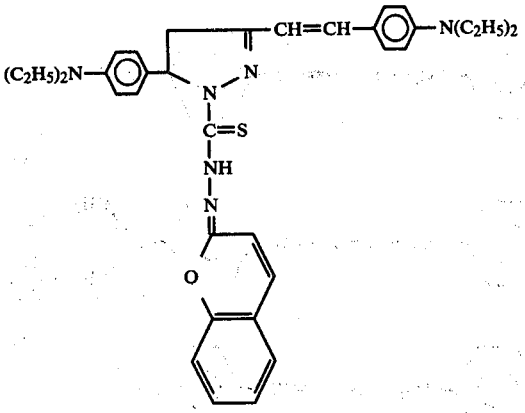

-continued (3-11)

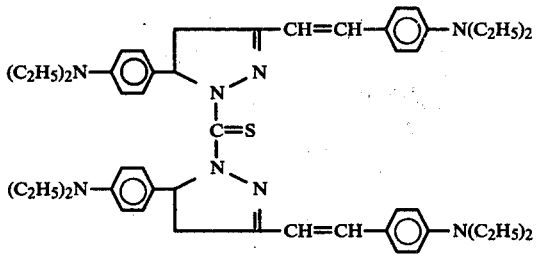

(3-12)

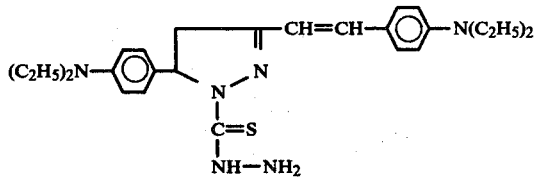

Of course, compounds that can be used are not limited to those exemplified above. These pyrazoline compounds may be used alone or in the form of mixtures of two or more of them.

The compound (3) may be prepared according to various known methods. For example, a compound (3) of the formula (3a) can be prepared by heating equimolar amounts of a carbohydrazide compound and an $\alpha,\beta$-unsaturated carbonyl compound in an organic solvent in the presence of an acid such as acetic acid or hydrochloric acid to effect condensation and ring closure. A compound (3) of the formula (3b) or (3c) can be obtained by condensing an equimolar amount of a carbonyl compound with the so-obtained compound (3a, in this case $R_7$ and $R_8$ each signifies a hydrogen atom) in an organic solvent under heating, if necessary, in the presence of an acid.

As preferred examples of the sulfonylhydrazone compound (4) of the general formula (4a), the following compounds can be mentioned:

(4-1)

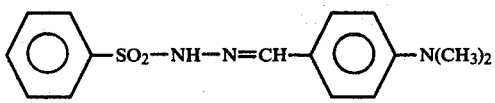

(4-2)

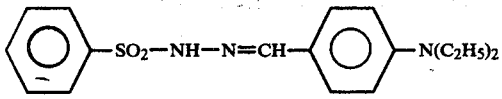

(4-3)

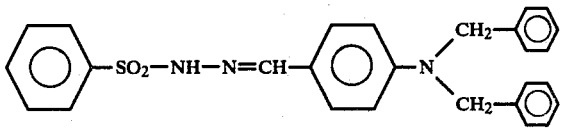

(4-4)

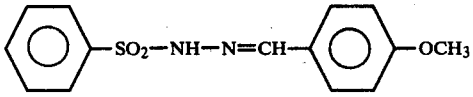

-continued (4-5)

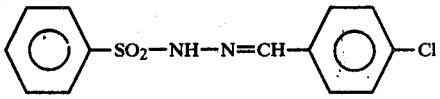

(4-6)

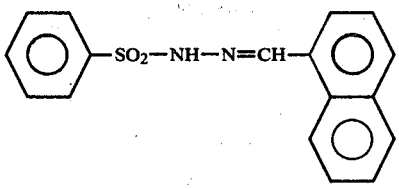

(4-7)

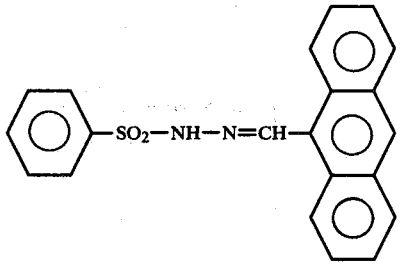

(4-8)

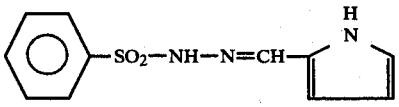

(4-9)

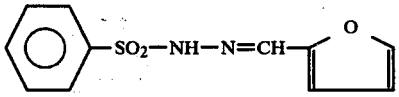

(4-10)

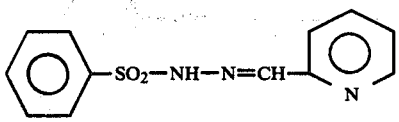

(4-11)

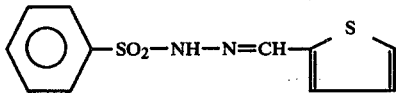

(4-12)

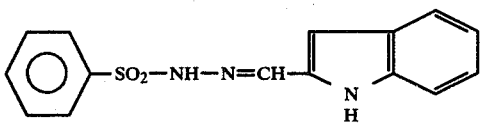

(4-13)

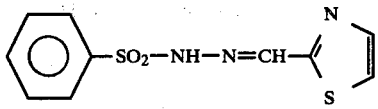

(4-14)

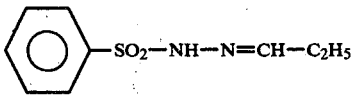

(4-15)

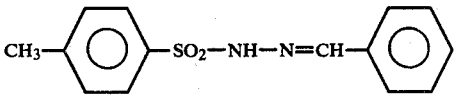

-continued
(4-16)
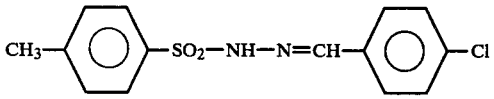
(4-17)
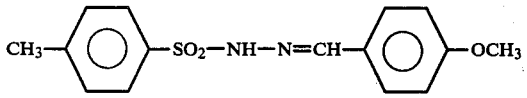
(4-18)
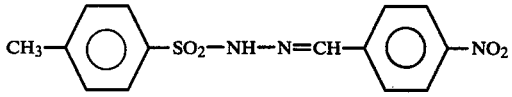
(4-19)
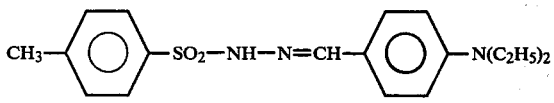
(4-20)
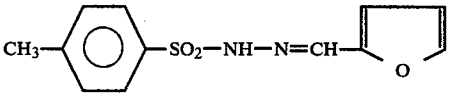
(4-21)
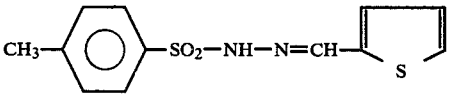
(4-22)
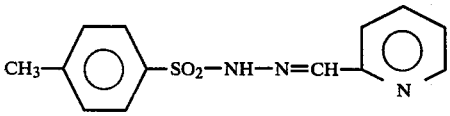
(4-23)
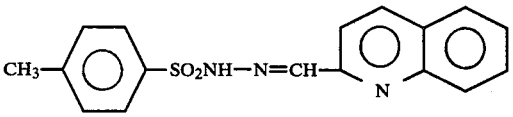
(4-24)
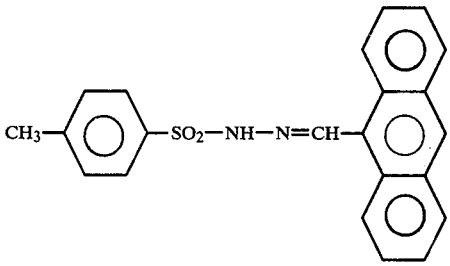
(4-25)
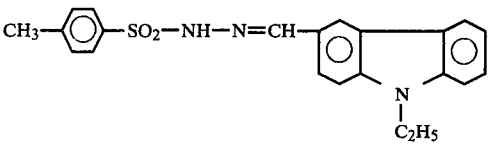
-continued
(4-26)
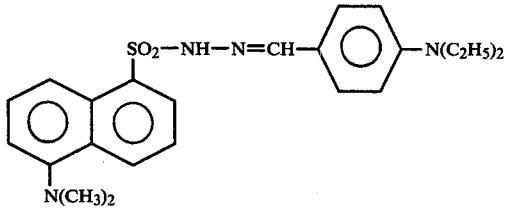
(4-27)
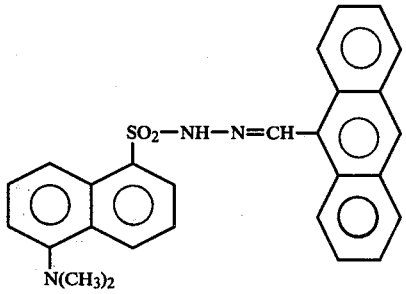
(4-28)
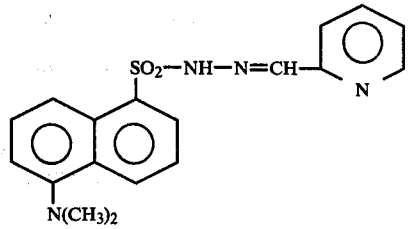
(4-29)
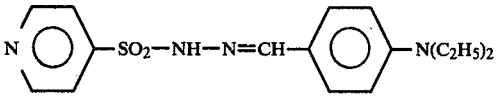
(4-30)
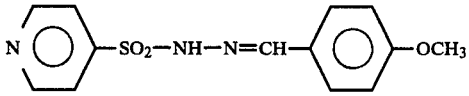
(4-31)
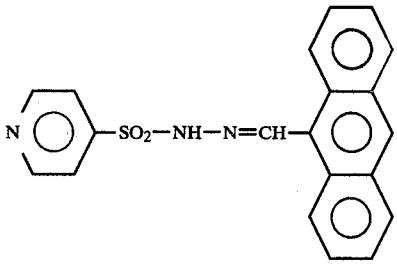
(4-32)
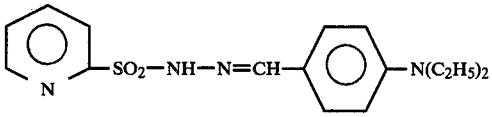
(4-33)
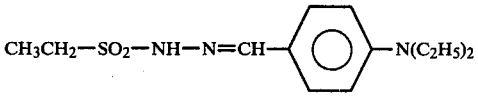

Furthermore, compounds, having at least two sulfonylhydrazone groups, for example, compounds having the following formula:

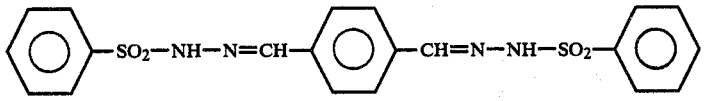

(4-34)

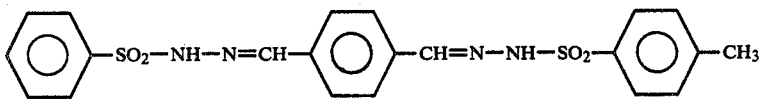

(4-35)

can be used effectively. Of course, compounds, that can be used are not limited to those exemplified above. These sulfonylhydrazone compounds may be used alone or in the form of mixtures of two or more of them.

The compound (4) can be prepared according to a known method. More specifically, the compound (4) can be prepared by condensing equimolar amounts of a sulfonylhydrazine compound and an aldehyde compound in an organic solvent under heating, if necessary, in the presence of an acid such as acetic acid or hydrochloric acid.

As preferred examples of the sulfonylhydrazone compound (5) of the formula (5a), the following compounds can be mentioned:

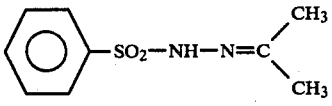

(5-1)

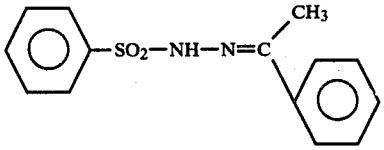

(5-2)

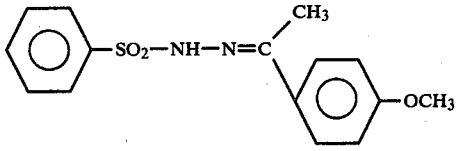

(5-3)

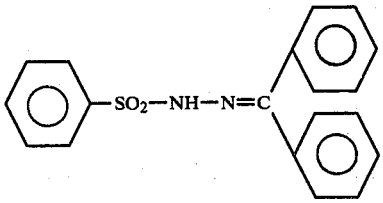

(5-4)

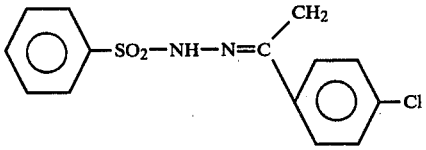

(5-5)

-continued (5-6)

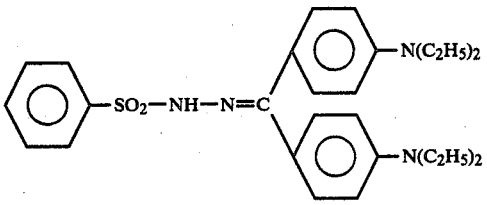

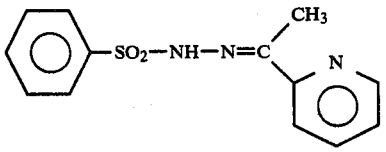

(5-7)

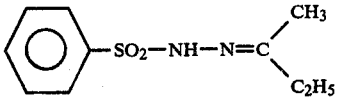

(5-8)

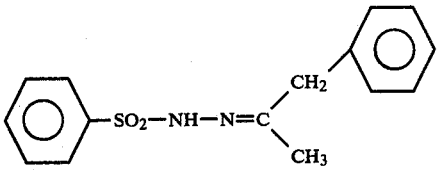

(5-9)

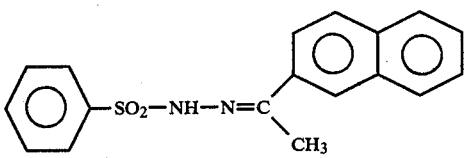

(5-10)

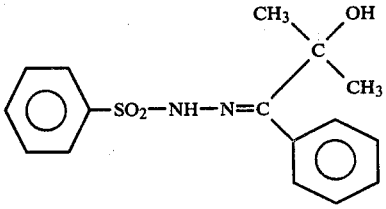

(5-11)

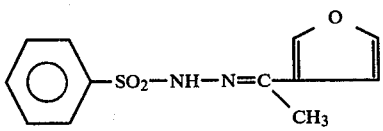

(5-12)

-continued (5-13)

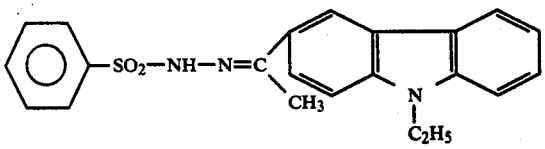

(5-14)

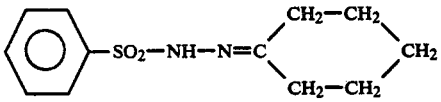

(5-15)

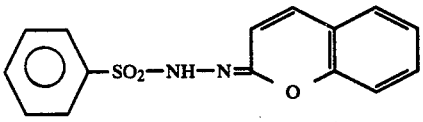

(5-16)

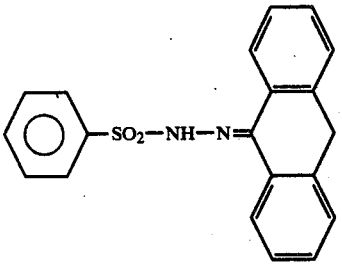

(5-17)

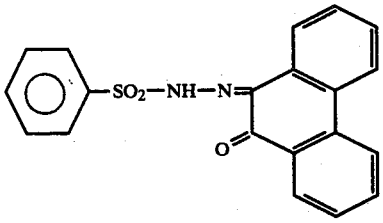

(5-18)

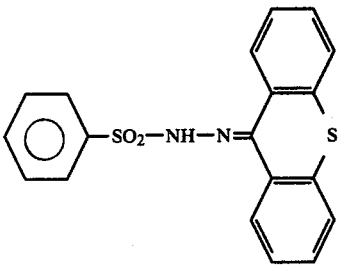

-continued (5-19)

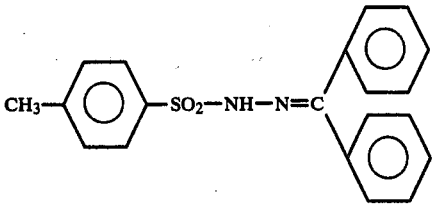

(5-20)

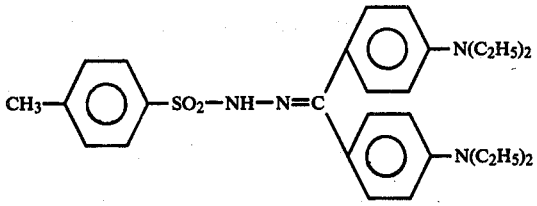

(5-21)

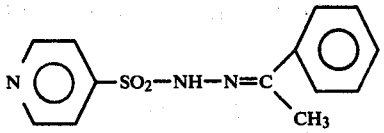

(5-22)

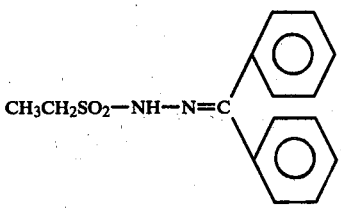

Furthermore, compounds having at least two sulfonylhydrazone groups, such as compounds having the following formulae:

(5-23)

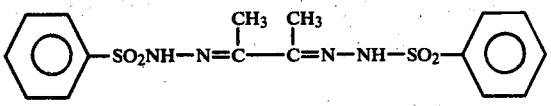

(5-24)

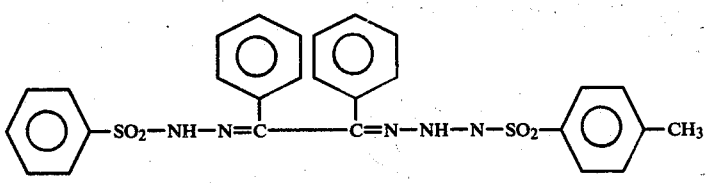

can be used effectively. Of course, compounds that can be used are not limited to those exemplified above. These sulfonylhydrazone compounds may be used alone or in the form of mixtures of two or more of them.

The compound (5) can be prepared according to a known method. More specifically, the compound (5) can be prepared by condensing equimolar amounts of a sulfonyhydrazine compound and a carbonyl group-containing compound in an organic solvent under heating, if necessary, in the presence of an acid such as acetic acid or hydrochloric acid.

As preferred examples of the pyrazoline compound (6) of the formula (6a), the following compounds can be mentioned:

(6-1)
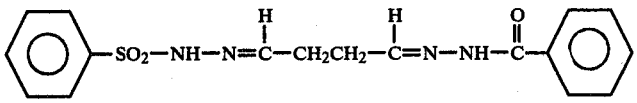
(6-2)
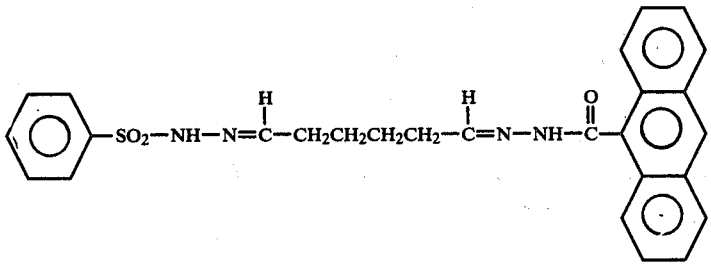
(6-3)
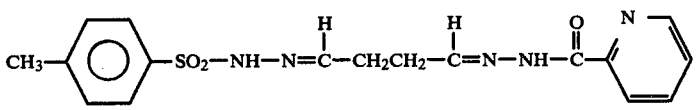
(6-4)
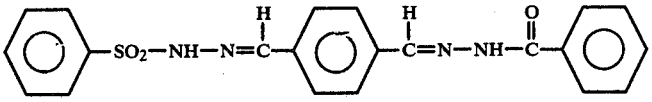
(6-5)
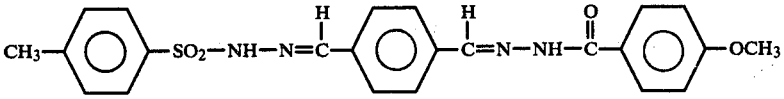
(6-6)
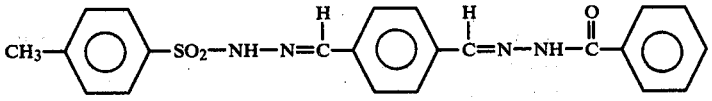
(6-7)
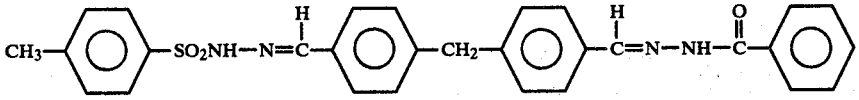
(6-8)
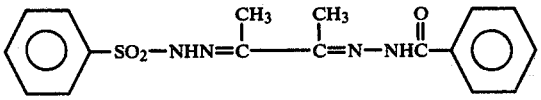
(6-9)
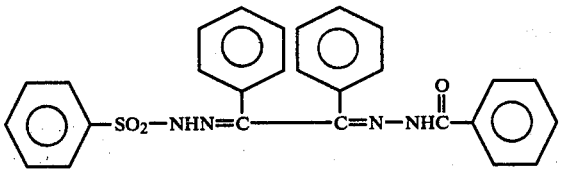
(6-10)
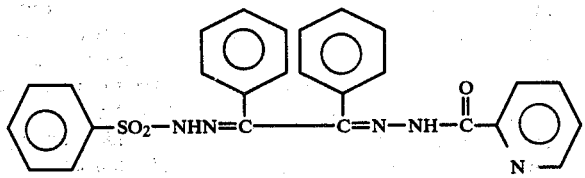
Furthermore, compounds having at least two acylhydrazone or sulfonylhydrazone groups, for example, a compound of the following formula:

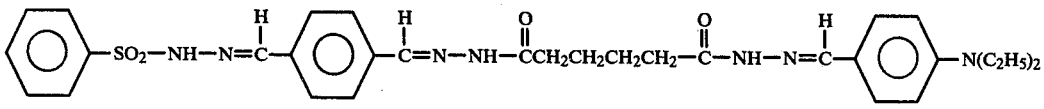

(6-11)

can be used effectively. Of course, compounds that can be used are not limited to those exemplified above. These compounds having at least one acylhydrazone group and at least one sulfonylhydrazone group may be used alone or in the form of mixtures of two or more of them.

The compound (6) can be prepared according to a known method. More specifically, the compound (6) can be prepared by condensing equimolar amounts of a sulfonylhydrazine compound and a dialdehyde compound in an organic solvent under heating, if necessary, in the presence of an acid such as acetic acid or hydrochloric acid and condensing the obtained sulfonylhydrazone compound with an equimolar amount of an acylhydrazide compound in an organic solvent under heating, if necessary, in the presence of an acid such as acetic acid or hydrochloric acid.

As preferred examples of the semicarbazone compound (7) of the general formula (7a) or (7b), the following compounds can be mentioned:

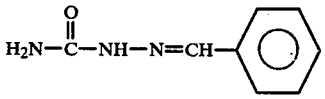

(7-1)

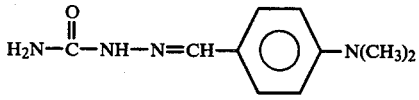

(7-2)

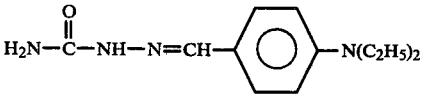

(7-3)

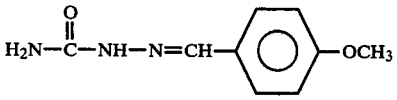

(7-4)

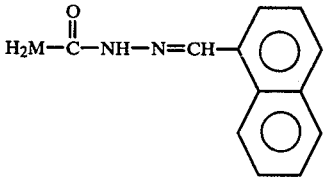

(7-5)

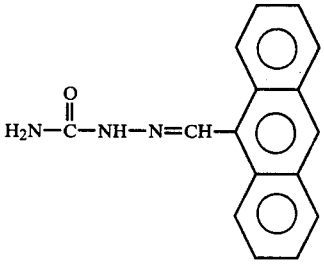

(7-6)

-continued

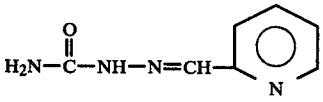

(7-7)

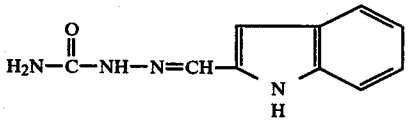

(7-8)

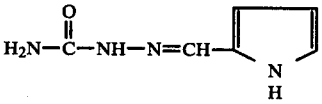

(7-9)

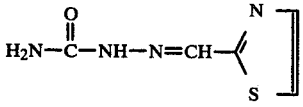

(7-10)

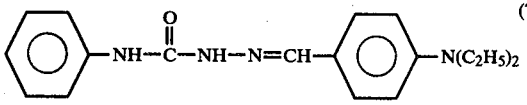

(7-11)

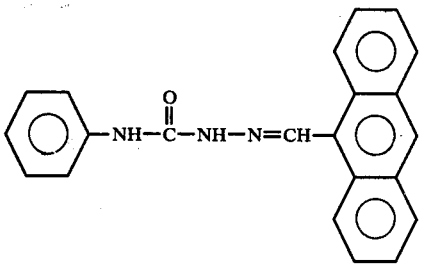

(7-12)

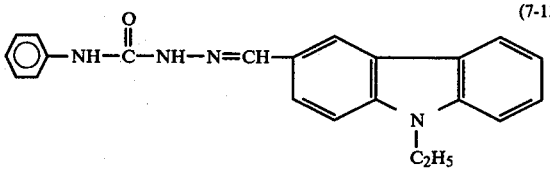

(7-13)

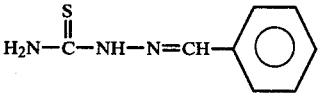

(7-14)

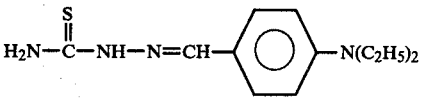

(7-15)

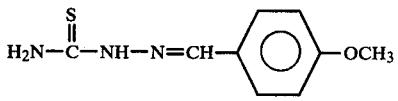

(7-16)

-continued
(7-17)
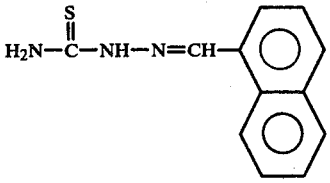
(7-18)
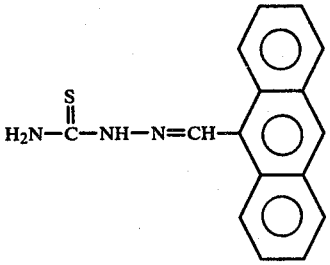
(7-19)
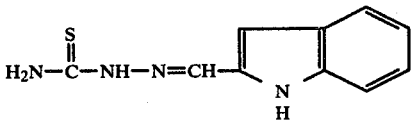
(7-20)
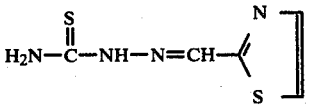
(7-21)
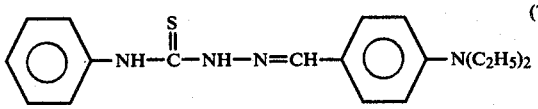
(7-22)
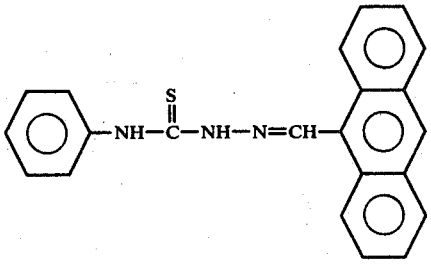
(7-23)
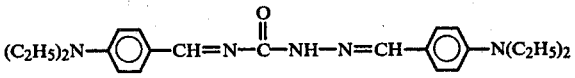
(7-24)
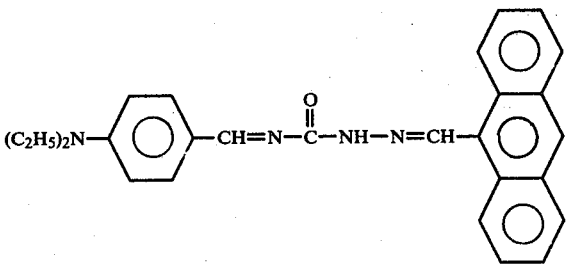
-continued
(7-25)
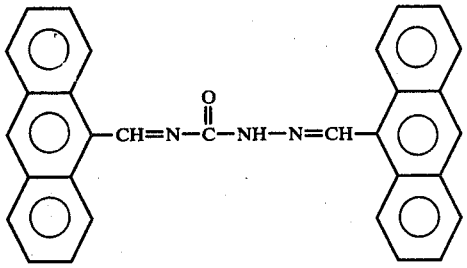
(7-26)
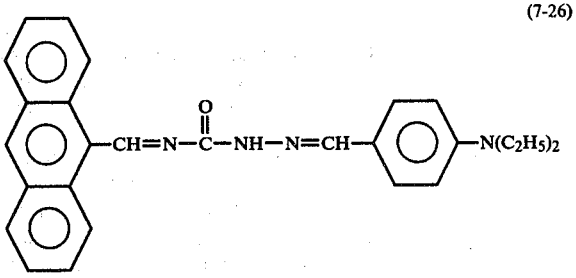
(7-27)
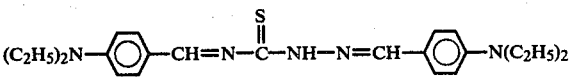
(7-28)
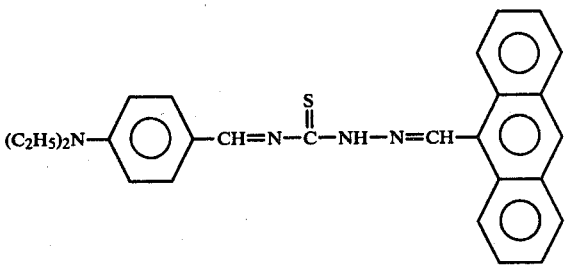
(7-29)
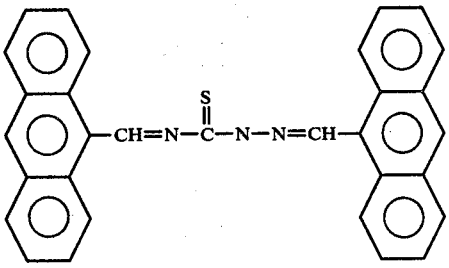
(7-30)
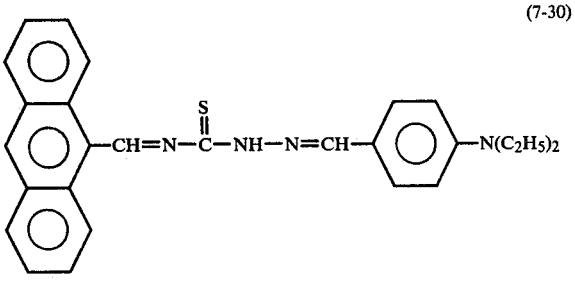

-continued (7-31)

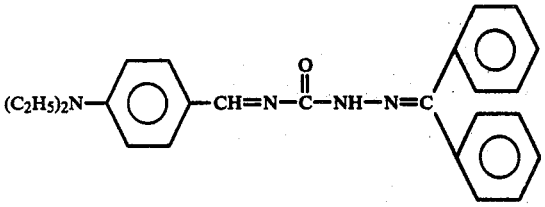

-continued (7-33)

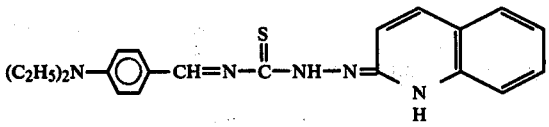

Furthermore, compounds having at least two semicarbazone groups, such as compounds of the following formulae:

(7-34)

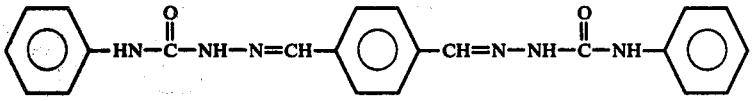

(7-35)

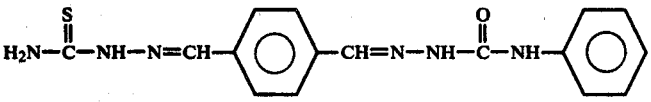

(7-32)

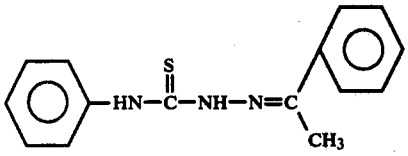

can be used effectively. Of course, compounds that can be used are not limited to those exemplified above. These semicarbazone compounds can be used alone or in the form of mixtures of two or more of them. The compound (7) can be prepared according to a known method. More specifically, the compound (7) can be prepared by condensing a carbonyl group-containing compound with an equimolar amount or a ½ molar equivalent of a semicarbazide compound in an organic solvent under heating, if necessary, in the presence of an acid such as acetic acid or hydrochloric acid.

As preferred examples of the carbohydrazone compound (8) having the general formula (8a), or (8b), the following compounds can be mentioned:

(8-1)

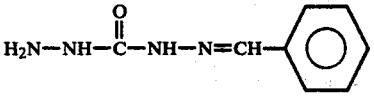

(8-2)

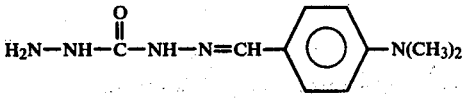

(8-3)

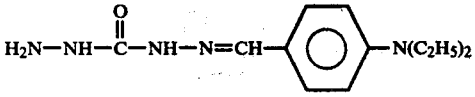

(8-4)

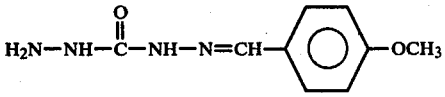

(8-5)

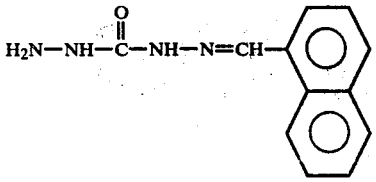

(8-6)

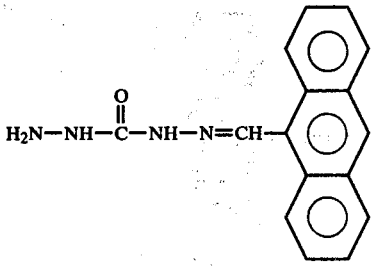

(8-7)

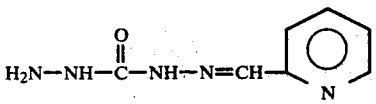

(8-8)

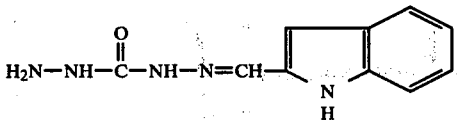

-continued
(8-9)
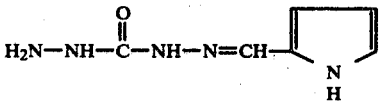
(8-10)
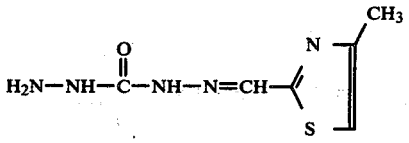
(8-11)
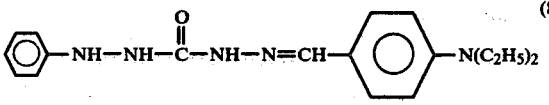
(8-12)
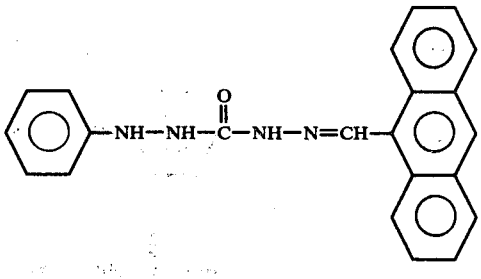
(8-13)
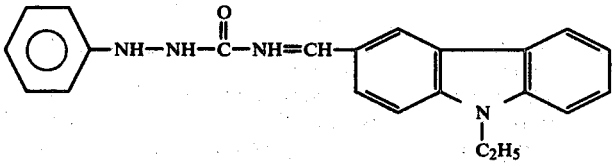
(8-14)
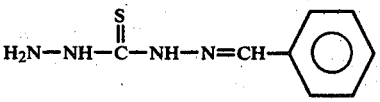
(8-15)
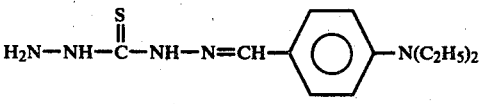
(8-16)
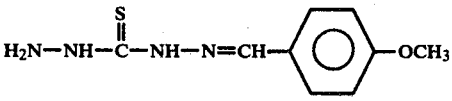
(8-17)
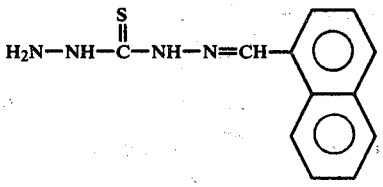
(8-18)
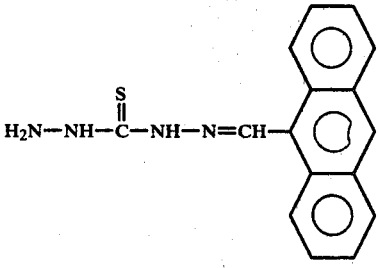
(8-19)
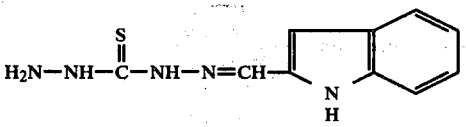
(8-20)
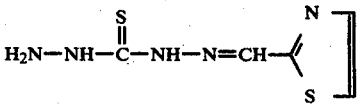
(8-21)
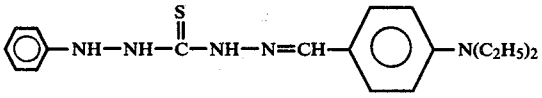

-continued
(8-22)
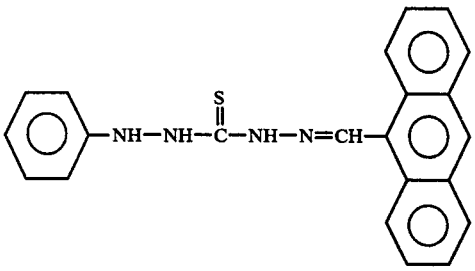
(8-23)
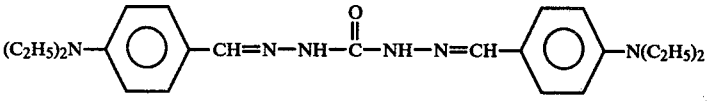
(8-24)
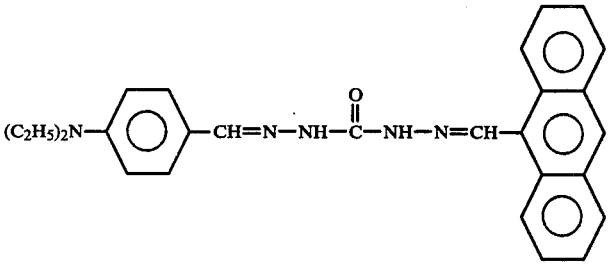
(8-25)
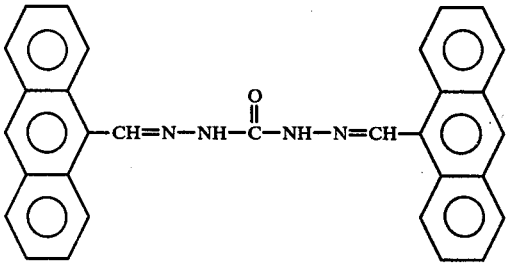
(8-26)
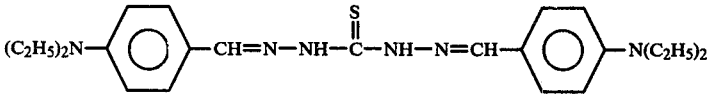
(8-27)
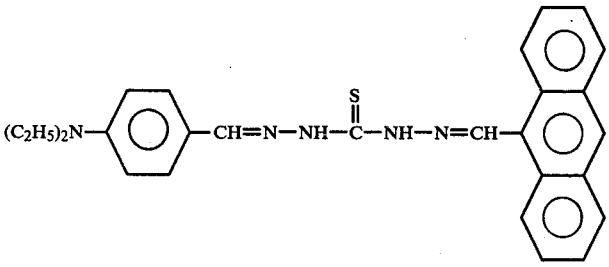
(8-28)
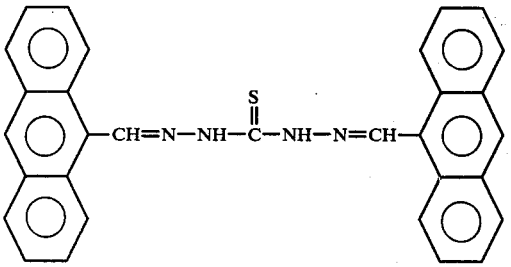

-continued (8-29)

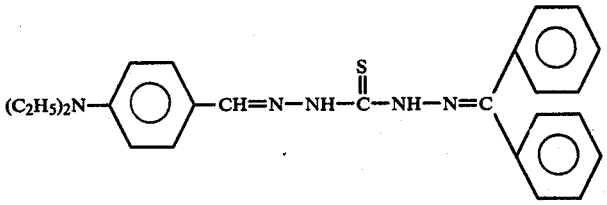

(8-30)

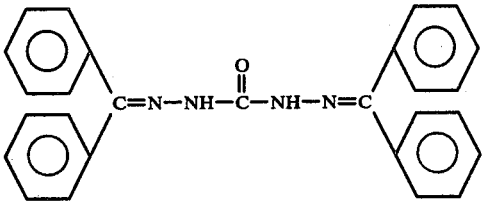

(8-31)

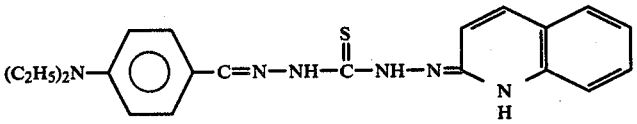

(8-32)

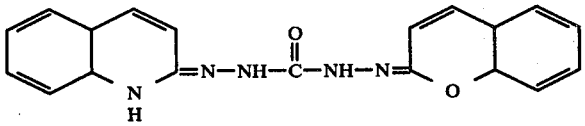

Furthermore, compounds having at least two carbohydrazone groups, such as compounds having the following formulae:

The above-mentioned compounds (1) through (8) may be used in the form of mixtures of two or more of them.

(8-33)

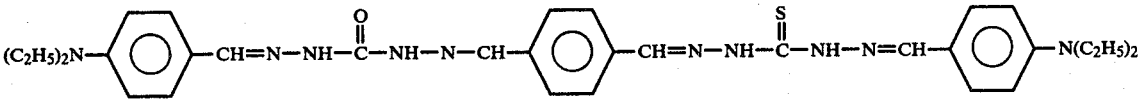

(8-34)

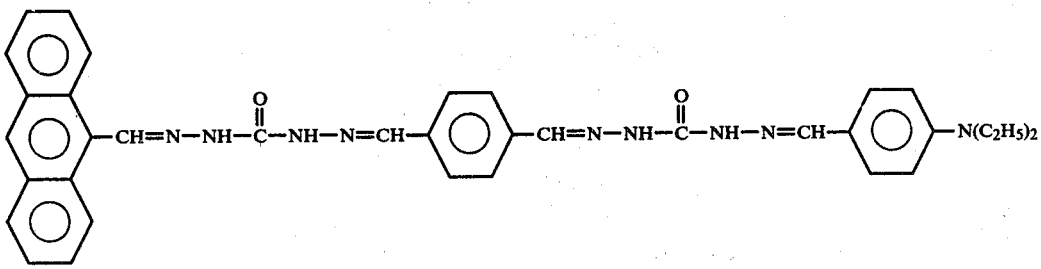

can be used effectively. Of course, compounds that can be used are not limited to those exemplified above. These carbohydrazone compounds may be used alone or in the form of two or more of them.

The compound (8) can be prepared according to a known method. More specifically, the compound (8) of the formula (8a) or (8b) can be prepared by condensing a carbonyl group-containing compound with an equimolar amount or a ½ molar equivalent of a carbohydrazide compound in an organic solvent under heating, if necessary, in the presence of an acid such as acetic acid or hydrochloric acid.

The compounds (1) through (8) are advantageously used in various fields as photoconductors which are rendered photoconductive under irradiation with light.

Known polymeric binders may be used in the present invention. For example, polyamides, polyurethanes, polyesters, polyester-amides, polyethers, polycarbonates, polyamide-imides, homopolymers and copolymers of acrylic acid esters, homopolymers and copolymers of methacrylic acid esters, homopolymers and copolymers of styrene, homopolymers and copolymers of vinyl acetate, homopolymers and copolymers of vinyl chloride, polyvinyl acetals, homopolymers and copolymers of chlorinated olefins, alkyd resins, silicone resins, keton resins, xylene resins and epoxy resins can be mentioned. Of course, polymeric binders that can be used are not limited to those exemplified above. These polymeric binders may be used alone or in the form of blends or copolymers of two or more of them. Furthermore, these polymeric binders may be crosslinked with appropriate crosslinking agents.

The organic photoconductor used in the present invention is effective as a photoconductor and excellent as the charge transport material. Accordingly, when the organic photoconductor of the present invention is used for an electrophotographic photosensitive material, a photosensitive layer of the organic photoconductor and polymeric binder can be used as a photoconductive layer or charge transport layer in any known modes. As typical instances, there can be mentioned (a) an electroconductive substrate/photoconductive layer structure, (b) an electroconductive substrate/charge generating layer/charge transport layer structure and (c) an electroconductive substrate/charge transport layer/charge generating layer structure.

In case of the structure (a), the photoconductive layer includes the following three types, that is, (i) a photoconductive layer comprising at least one photoconductor selected from the above-mentioned compounds (1) through (8), a polymeric binder and, if necessary, a sensitizing dye, (ii) a photoconductive layer comprising a charge generating material, at least one photoconductor selected from the above-mentioned compounds (1) through (8) and a polymeric binder, (iii) a photoconductive layer comprising at least one photoconductor selected from the above-mentioned compounds (1) through (8), a charge generating material, a sensitizing dye and a polymeric binder.

In case of the structure (b) or (c), the charge generating layer contains a charge generating material, and the charge transport layer comprises at least one photoconductor selected from the above-mentioned compounds (1) through (8) and a polymeric binder.

Each of the photoconductive layer, charge generating layer and charge transport layer may be a laminate of at least two layers differing in the composition. Furthermore, in the above-mentioned structures (a), (b) and (c), an intermediate layer may be disposed between the electroconductive substrate and the photoconductive layer, charge generating layer or charge transport layer. More specifically, there may adopted (d) an electroconductive substrate/intermediate layer/photoconductive layer structure, (e) an electroconductive substrate/intermediate layer/charge generating layer/charge transport layer structure and (f) an electroconductive substrate/intermediate layer/charge transport layer/charge generating layer structure. By the term "intermediate layer" used herein are meant an adhesive layer and a barrier layer. It is preferable that the thickness of the intermediate layer be not thicker than 20$\mu$, especially not thicker than 5$\mu$.

In the present invention, the photoconductive layer or charge generating layer can be formed either directly on the electroconductive substrate or charge transport layer or on an intermediate layer formed thereon according to need, by vacuum deposition of the photoconductor or charge generating material or by coating of a dispersion formed by dispersing the photoconductor or charge generating material in the form of fine particles in a dispersion medium by a ball mill, a homogenizing mixer or the like and, if necessary, incorporating a polymeric binder into the dispersion.

Furthermore, the photoconductive layer, charge generating layer, charge transport layer and intermediate layer may be formed according to any of conventional coating methods such as a film-applying method, a brush coating method, a dip coating method, a knife coating mentod, a roll coating method, a spray coating method, a flow coating method and a rotational coating method using a spinner or wheeler.

As the sensitizing dye, there can be mentioned triphenylmethane dyes such as Brilliant Green, Victoria Blue B, Methyl Violet, Crystal Violet and Acid Violet 6B; rhodamine dyes such as Rhodamine B, Rphdamine 6G, Rhodamine G Extra, Sulforhodamine B and Fast Acid Eosine G; xanthene dyes such as Eosine S, Eosine A, Erythrocin, Phloxine, Rose Bengale and Fluorosceine; thiazine dyes such as Methylene Blue; acridine dyes such as Acridine Yellow, Acridine Orange and Trypaflavin; quinoline dyes such as Pinacyanol and Cryptocyanine; quinone and ketone dyes such as Alizarine, Alizarine Red S and Quinizarin; cyanine dyes; chlorophyll; allylmethane dyes such as Violet Fuchsine, Erythrocin 2Na, Rhodamine B500, Fanal Pink B, Rhodamine 6GDN and Auramine; polymethine dyes such as 3,3'-diethylthiacarbocyanine iodide; azo dyes such as Eriochrome Blue Black R; azomethine dyes such as bis(p-dimethylaminobenzal) azine; carbonyl dyes such as Solway Ultra Blue B and Alizarine Cyanine Green GWA; heterocyclic compounds such as N,N'-pentamethylene-bis(benzthiazole) perchlorate; and phthalocyanine dyes such as Segnale Light Turquoise. Sensitizing dyes that can be used are not limited to those exemplified above.

Conventional charge generating materials can be used in the present invention. For example, inorganic photoconductors such as selenium, selenium alloys and cadmium sulfide, and organic photoconductors such as phthalocyanine pigments, perylene pigments, anthraquinone pigments, azo pigments, bisazo pigments, cyanine pigments, thioindigo pigments, indigo pigments, quinacridone pigments and perinone pigments can be mentioned. These charge generating materials may be used alone or in the form of mixtures of two or more of them.

In the present invention, if necessary, a protective layer may be formed on the surface of the electrophotographic photosensitive material [in case of the structure (b), for example, there can be mentioned an electroconductive substrate/charge generating layer/charge transport layer/protective layer structure], or an antistatic layer may be formed on the back surface [in case of the structure (b), there can be mentioned an antistatic layer/electroconductive layer/charge generating layer/charge transport layer structure].

In the present invention, a transparent electrophotographic photosensitive material comprising a transparent photosensitive layer formed on a transparent electroconductive substrate may be used as a slide film, a micro-film or an OHP film. When this transparent electrophotographic photosensitive material is applied to the electrophotographic process in which light exposure is effected from the side of the transparent electroconductive substrate, a white dielectric layer may be formed on the photosensitive layer, if necessary. In case of this electrophotographic photosensitive material, if a toner image formed, for example, on the white dielectric layer is directly fixed, a clear image is formed and an especially clear image is obtained in case of the color reproduction. Accordingly, the electrophotographic photosensitive material of this type is valuable for this purpose.

Various additives may be incorporated into the photoconductive layer, charge generating layer and charge transport layer in the present invention. For example, when these layers are formed by coating a plastizer may be used for improving the flowability at the coating step or the smoothness of the resulting coating. Moreover, such additives as an adhesion promotor, a stabilizer, an antioxidant, an ultraviolet absorber and a lubricant may be incorporated. Furthermore, known organic photoconductors, charge generating materials and charge transport materials may be incorporated according to need, so far as the characteristics of the electrophotographic photosensitive material of the present invention are not degraded.

In the photoconductive layer of the photosensitive material having the above-mentioned structure (a) according to the present invention, it is preferable that the organic photoconductor/polymeric binder/sensitizing dye/charge generating material/additive weight ratio be 1/(0.5 to 30)/(0 to 0.2)/(0 to 0.5)/(0 to 1), and in the charge transport layer of the photosensitive material having the above-mentioned structure (b) or (c) according to the present invention, it is preferable that the organic photoconductor/polymeric binder/additive weight ratio be 1/(0.5 to 30)/(0 to 1).

In the above-mentioned structure (a), it is preferable that the thickness of the photoconductive layer be 2 to 50μ. In the above-mentioned structure (b) or (c), it is preferable that the thickness of the charge generating layer be 0.01 to 5μ and the thickness of the charge transport layer be 3 to 30μ. The kind of the electroconductive substrate is not particularly critical. For example, papers and plastic films which are rendered electroconductive by application of an electroconductive compound or a metal foil layer, and metal sheets may be used as the electroconductive substrate.

Since the so-obtained electrophotographic photosensitive material comprises a photoconductive layer or charge transporting layer containing at least one organic photoconductor selected from the above-mentioned compounds (1) through (8) and a polymeric binder, which is formed on an electroconductive substrate, the electrophotographic photosensitive material is excellent in charge acceptance and a charge retentivity and has a high sensitivity as well as a good durability.

Although the starting compounds of known hydrazone and pyrazoline derivatives are, for example, phenylhydrazine and diphenylhydrazine which are carcinogenic substances, the starting compounds of the organic photoconductors used in the present invention are sulfonyl hydrazide, thiosemicarbazide and carbohydrazide having a high safety. Futhermore, since the organic photoconductors used in the present invention have a high compatibility with conventional polymeric binders, the range for the selection of polymeric binders is very broad. Accordingly, at the developing step, not only a two-component type toner but also a one-component type toner can be applied to an electrophotographic photosensitive material having a photosensitive layer containing the organic photoconductor of the present invention and a polymeric binder. Therefore, also the range for the selection of toners is broadened. Moreover, since the organic photoconductor used in the present invention is excellent as the charge transport material, the range for the selection of charge generating materials to be combined with the organic photoconductor is also broadened.

Some of electrophotographic photosensitive materials of the present invention having the above-mentioned structure (b), that is, the electroconductive substrate/charge generating layer/charge transport layer structure, are effective for the positive charging as well as for the negative charging. The amount of ozone generated at the positive charging by the corona discharge is ordinarily smaller than at the negative charging by the corona discharge, and the contamination of the environment is reduced at the positive charging. Therefore, the positive charging is ordinarily preferable. A few of organic photoconductors are effective for the positive charging, and in many cases, the negative charging is inevitably adopted. In view of the foregoing, it is significant that the electrophotographic phtosensitive material of the present invention having the above-mentioned structure (b) is effective for the positive charging.

In the present invention, the electrophotographic properties are determined according to the following procedures. By using an electrostatic paper analyzer (Model EPA-SP-428 supplied by Kawaguchi Electric Work Co., Ltd.), a voltage of −6 KV is applied for 6 seconds, and the acceptance potential is measured. Then, the dark decay is performed for 5 seconds and the dark decay quantity is measured. Then, the light exposure is carried out at 300/7 luxes for 15 seconds by using a tungsten light having a color temperature of 2854° K. as the light source and the exposure for half decay was measured. The acceptance potential thus determined indicates the static charge acceptance in the dark, the dark decay quantity indicates the charge retentivity in the dark, and the exposure for half decay indicates the sensitivity.

The present invention will now be described in detail with reference to the following examples that by no means limit the scope of the invention.

EXAMPLE 1

The compounds (1–8), (2–10), (3–12), (4–19), (5–15), (6–6), (7–19) and (8–3) were prepared. These compounds were independently mixed with a polyester resin (Toyobo "Vylon" 200) and tetrahydrofuran to form solutions (1), (2), (3), (4), (5), (6), (7) and (8), respectively. In each run, the photoconductive compound/polyester resin/tetrahydrofuran weight ratio was 10/10/150.

Separately, eight electroconductive films were prepared by vacuum-depositing aluminum in a thickness of 0.1μ on one surfaces of biaxially drawn polyethylene terephthalate films having a thickness of 100μ ("Lumirror" supplied by Toray Industries).

The above solutions (1) through (8) were independently coated on the Al-deposited surfaces of these electroconductive films so that the thickness of the coating after drying was 10μ, whereby electrophotographic photosensitive materials (11), (12), (13), (14), (15), (16), (17) and (18) were obtained, respectively.

With respect to each of the so-obtained eight electrophotographic photosensitive materials, the acceptance potential and the exposure for half decay were determined. The obtained results are shown in Table 1, from which it is seen that each of the foregoing compounds is a good organic photoconductor.

TABLE 1

| Photosensitive Material No. | Acceptance potential (V) | Exposure for half decay (lux · sec) |
|---|---|---|
| (11) | 590 | 80 |
| (12) | 610 | 70 |

TABLE 1-continued

| Photosensitive Material No. | Acceptance potential (V) | Exposure for half decay (lux · sec) |
|---|---|---|
| (13) | 700 | 80 |
| (14) | 530 | 50 |
| (15) | 500 | 55 |
| (16) | 500 | 75 |
| (17) | 600 | 45 |
| (18) | 570 | 70 |

EXAMPLE 2

A dispersion obtained by pulverizing in a ball mill a mixture comprising metal-free phthalocyanine, a poyester resin (Toyobo "Vylon" 200) and tetrahydrofuran at a weight ratio of 30/10/960 was coated in a thickness of 0.5μ (after drying) on the Al-deposited surface of each of eight electroconductive films obtained in the same manner as described in Example 1 to form a charge generating layer.

The solutions (1) through (8) prepared in Example 1 were independently coated in a thickness of 15μ (after drying) on the so-formed charge generating layers to form electrophotographic photosensitive materials (21) through (28) having a charge transport layer, respectively.

With respect to each of the so-obtained eight photosensitive materials, the acceptance potential, the dark decay quantity and the exposure for half decay were determined. The results are shown in Table 2, from which it is seen that each of the electrophotographic photosensitive materials of the present invention has a high acceptance potential, a good charge retentivity and a high sensitivity. It also is seen that the photosensitive materials of this example are especially excellent as the charge transport material as compared with the photosensitive materials of Example 1.

TABLE 2

| Photosensitive Material No. | Acceptance potential (V) | Dark decay quantity (V) | Exposure for half decay (lux · sec) |
|---|---|---|---|
| (21) | 620 | 100 | 12 |
| (22) | 630 | 100 | 13 |
| (23) | 730 | 130 | 12 |
| (24) | 570 | 120 | 12 |
| (25) | 650 | 80 | 11 |
| (26) | 560 | 100 | 12 |
| (27) | 490 | 100 | 8 |
| (28) | 590 | 100 | 12 |

EXAMPLE 3

The compounds (1-2), (2-14), (3-6), (4-2), (5-4), (6-10), (7-24) and (8-27) were prepared. These compounds were independently mixed with a polyester resin (1:1 mixture of Toyobo "Vylon" 200 and 300) and tetrahydrofuran to form solutions (31), (32), (33), (34), (35), (36), (37) and (38), respectively. In each run, the photoconductive compound/polyester resin/tetrahydrofuran weight ratio was 10/10/150.

Separately, a dispersion formed by pulverizing in a ball mill mixture comprising Dian Blue (CI Pigment Blue 25CI 21180) as a bisazo pigment, a polyester resin (Toyobo "Vylon" 200) and tetrahydrofuran at a weight ratio of 30/10/960 was coated in a thickness of 0.5μ (after drying) on the Al-deposited surface of each of eight electroconductive film prepared in the same manner as described in Example 1 to form charge generating layers on the respective electroconductive films.

The above-mentioned solutions (31) through (38) were independently coated in a thickness of 18μ (after drying) on the charge generating layers to form electrophotographic photosensitive materials (31), (32), (33), (34), (35), (36), (37) and (38), respectively.

With respect to each of the so-obtained eight photosensitive materials, the acceptance potential, the dark decay quantity and the exposure for half decay were determined. The results are shown in Table 3, from which it is seen that each of the electrophotographic photosensitive materials of this example has a high acceptance potential, a good charge retentivity and a high sensitivity. It also is seen that the photosensitive materials of this example are especially excellent as the charge transport material as compared with the photosensitive materials of Example 1.

TABLE 3

| Photosensitive Material No. | Acceptance potential (V) | Dark decay quantity (V) | Exposure for half decay (lux · sec) |
|---|---|---|---|
| (31) | 580 | 90 | 15 |
| (32) | 700 | 120 | 15 |
| (33) | 690 | 100 | 16 |
| (34) | 500 | 110 | 14 |
| (35) | 610 | 60 | 13 |
| (36) | 510 | 90 | 15 |
| (37) | 960 | 90 | 10 |
| (38) | 540 | 90 | 17 |

EXAMPLE 4

A solution obtained by mixing the compound (7-15), a polycarbonate (Teijin "Panlight" K1300) and tetrahydrofuran at a weight ratio of 7/3/90 was coated in a thickness of 20μ (after drying) on the charge generating layer obtained in Example 2 to obtain an electrophotographic photosensitive material. It was found that this electrophotographic photosensitive material had an acceptance potential of 680 V and an exposure for half decay of 8 lux·sec. Thus, it has confirmed that this electrophotographic photosensitive material had excellent electrophotographic characteristics. The charge transport layer of this photosensitive material was transparent and uniform.

Comparative Example 1

An electrophotographic photosensitive material was prepared in the same manner as described in Example 4 except that 1,3,5-triphenyl-2-pyrazoline was used instead of the compound (7-15). Precipitation of crystals of 1,3,5-triphenyl-2-pyrazoline was observed on the surface of the charge transport layer of the obtained photosensitive material. After the precipitated crystals had been removed, the electrophotographic characteristics were determined. It was found that the acceptance potential was 550 V and the exposure for half decaly was 14 lux·sec. Accordingly, it was confirmed that the organic photoconductor (7-15) has a better compatibility with a polymeric binder.

EXAMPLE 5

A solution was prepared by mixing the compound (7-15) of the present invention, Rhodamine 6G, a polycarbonate (Mitsubishi Gas Chemical Co. "Iupilon" S-2000) and tetrahydrofuran at a weight ratio of 10/1/10/150. The solution was coated in a thickness of 16μ (after drying) on the charge generating layer prepared in Example 2 to obtain an electrophotographic photosensitive material. The photosensitive material was positively charged at +6 KV for 6 seconds, and the acceptance potential was measured. Then, the charged photosensitive material was subjected to the dark decay for 5 seconds, and the dark decay quantity was measured. Then, the photosensitive material was subjected to the light exposure at 300/7 luxes for 15 seconds by using a tungsten light as the light source, and the exposure for half decay was measured. It was found that the acceptance potential was 710 V, the dark decay quantity was 120 V and the exposure after half decaly was 18 lux·sec. Thus, it was confirmed that the electrophotographic photosensitive material can be effectively used also for the photographic process in which the positive charging is effected.

EXAMPLE 6

A solution obtained by mixing the compound (7-15), Rhodamine 6G, a polycarbonate (Teijin "Panlight" K1300) and tetrahydrofuran at a weight ratio of 10/1/15/150 was coated in a thickness of 15μ (after drying on a transparent electroconductive substrate comprising an electroconductive layer of $In_2O_3$—$SnO_2$ formed on one side of a polyester film ("Lumirror") having a thickness of 100μ, whereby a transparent electrophotographic photosensitive material was obtained. The electrophotographic characteristics of this photosensitive material were determined. Incidentally, the light exposure was effective either on the side of the photoconductive layer or on the side of the transparent electroconductive substrate. The results are shown in Table 4. The electrophotographic characteristics were substantially the same irrespectively of the light exposure directions. From the results shown in Table 4, it is seen that the transparent electrophotographic photosensitive material of this example has very excellent electrophotographic characteristics.

TABLE 4

| Electrophotographic Characteristics | Exposure on side of photoconductive layer | Exposure on side of electroconductive layer |
|---|---|---|
| Acceptance potential (V) | 730 | 730 |
| Exposure for half decay (lux · sec) | 20 | 21 |

EXAMPLE 7

A dispersion obtained by dispersing a liquid mixture comprising a polyester resin (Toyobo "Vylon" 200), titanium oxide and tetrahydrofuran at a weight ratio of 10/20/200 in a ball mill for 15 hours was coated in a thickness of 20μ (after drying) on the photoconductive layer of the transparent electrophotographic photosensitive material prepared in Example 6, to obtain an electrophotographic photosensitive material of the present invention having a transparent electroconductive substrate/transparent photosensitive layer/white dielectric layer structure. The photosensitive layer was positively charged by subjecting the side of the white dielectric layer to corona discharge at about +6 KV, and a white light as the light source was applied to the side of the transparent electroconductive substrate through an original by using an enlarging projector. A powdery developer was sprinkled on the white dielectric layer to form a visible image. The visible image was fixed by weak heating. The obtained image was precise reproduction of the original, and since the white dielectric layer acted as the background, the formed image was very sharp. Accordingly, it is seen that the electrophotographic photosensitive material of the present invention is excellent also as an electrophotographic film for the coated paper copy system.

We claim:

1. An electrophotographic photosensitive material comprising a photosensitive layer formed on an electroconductive substrate, said photosensitive layer containing a polymeric binder and an organic photoconductor represented by the following formula (I):

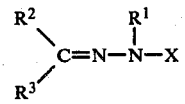

(I)

wherein $R^1$ and $R^2$ either form a pyrazoline ring together with

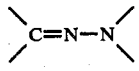

or are not included in the same ring, (i) in the case where $R^1$ and $R^2$ form a pyrazoline ring, $R^1$ is $>CHR^4$ (where $R^4$ is an alkyl group having 1 to 12 carbon atoms, an aralkyl group having 7 to 14 carbon atoms, an aryl group having 6 to 20 carbon atoms or a heterocyclic residue of 3- to 30-membered ring), $R^2$ is $>CH_2$, $R^3$ is $-(CH{=}CH)_nR^5$ (where $R^5$ is an alkyl group having 1 to 12 carbon atoms, an aralkyl group having 7 to 14 carbon atoms, an aryl group having 6 to 20 carbon atoms or a heterocyclic residue of 3- to 30-membered ring), X is

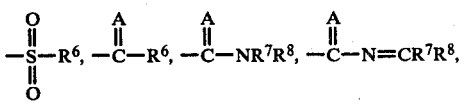

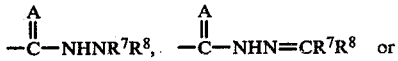

or

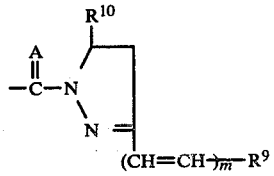

(wherein n is 0 or 1, m is 0 or 1, A is an oxygen atom or a sulfur atom, $R^6$, $R^9$ and $R^{10}$ independently signify an alkyl group having 1 to 12 carbon atoms, an aralkyl group having 7 to 14 carbon atoms, an aryl group having 6 to 20 carbon atoms or a heterocyclic residue of a 3-to 30-membered ring, and, $R^7$ and $R^8$ either form a ring together with the nitrogen atom to which $R^7$ and $R^8$ are bonded and in this case $R^7$ and $R^8$ independently A is an oxygen atom or a sulfur atom, $R^4$ and $R^5$ independently signify an alkyl group having 1 to 12 carbon atoms, an aralkyl group having 6 to 14 carbon atoms, an aryl group having 6 to 20 carbon atoms or a heterocyclic residue of a 3- to 30-membered ring, and $R^7$ and $R^8$ either form a ring together with the carbon or nitrogen atom to which $R^7$ and $R^8$ are bonded and in this case $R^7$ and $R^8$ independently signify a carbon, nitrogen, oxygen or sulfur atom, or, $R^7$ and $R^8$ are not included in the same ring and in this case $R^7$ and $R^8$ independently signify a hydrogen atom, an alkyl group having 1 to 12 carbon atoms, an aralkyl group having 1 to 14 carbon atoms, an aryl group having 6 to 20 carbon atoms or a heterocyclic residue of a 3- to 30-membered ring.

4. An electrophotographic photosensitive material as set forth in claim 1, wherein the organic photoconductor is a compound represented by the following general formula (3a), (3b) or (3c):

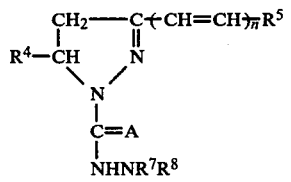

(3a)

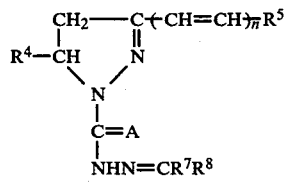

(3b)

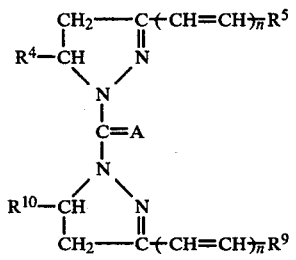

(3c)

wherein n is 0 or 1,

A is an oxygen atom or a sulfur atom, $R^4$, $R^5$, $R^9$ and $R^{10}$ independently signify an alkyl group having 1 to 12 carbon atoms, an aralkyl group having 7 to 14 carbon atoms, an aryl group having 6 to 20 carbon atoms or a heterocyclic residue of a 3- to 30-membered ring, and $R^7$ and $R^8$ either form a ring together with the carbon or nitrogen atom to which $R^7$ and $R^8$ are bonded and in this case $R^7$ and $R^8$ independently signify a carbon, nitrogen, oxygen or sulfur atom, or, $R^7$ and $R^8$ are not included in the same ring and in this case $R^7$ and $R^8$ independently signify a hydrogen atom, an alkyl group having 1 to 12 carbon atoms, an aralkyl group having 1 to 14 carbon atoms, an aryl group having 6 to 20 carbon atoms or a heterocyclic residue of a 3- to 30-membered ring.

5. An electrophotographic photosensitive material as set forth in claim 1, wherein the organic photoconductor is a compound represented by the following general formula (4a):

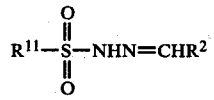

(4a)

wherein $R^2$ and $R^{11}$ independently signify an alkyl group having 1 to 12 carbon atoms, an aralkyl group having 7 to 14 carbon atoms, an aryl group having 6 to 20 carbon atoms or a heterocyclic residue of a 3- to 30-membered ring.

6. An electrophotographic photosensitive material as set forth in claim 1, wherein the organic photoconductor is a compound represented by the following general formula (5a):

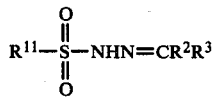

(5a)

wherein $R^2$ and $R^3$ either form a ring together with the carbon atom to which $R^2$ and $R^3$ are bonded and in this case $R^2$ and $R^3$ independently signify a carbon, nitrogen, oxygen or sulfur atom, or, $R^2$ and $R^3$ are not included in the same ring and in this case $R^2$ and $R^3$ independently signify an alkyl group having 1 to 12 carbon atoms, an aralkyl group having 7 to 14 carbon atoms, an aryl group having 6 to 20 carbon atoms or a heterocyclic residue of a 3- to 30-membered ring, and $R^{11}$ is an alkyl group having 1 to 12 carbon atoms, an aralkyl group having 7 to 14 carbon atoms, an aryl group having 6 to 20 carbon atoms or a heterocyclic residue of a 3- to 30-membered ring.

7. An electrophotographic photosensitive material as set forth in claim 1, wherein the organic photoconductor is a compound represented by the following general formula (6a):

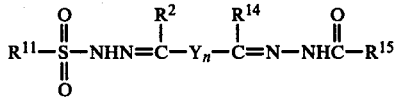

(6a)

wherein $R^{11}$ and $R^{15}$ independently signify an alkyl group having 1 to 12 carbon atoms, an aralkyl group having 7 to 14 carbon atoms, an aryl group having 6 to 20 carbon atoms or a heterocyclic residue of a 3- to 30-membered ring, $R^2$ and $R^{14}$ independently signify a hydrogen atom, an alkyl group having 1 to 12 carbon atoms, an aralkyl group having 7 to 14 carbon atoms, an aryl group having 6 to 20 carbon atoms or a heterocyclic residue of a 3- to 30-membered ring, Y is a divalent group selected from alkylene groups having 1 to 12 carbon atoms, aralkylene groups having 7 to 14 carbon atoms, arylene groups having 6 to 20 carbon atoms and heterocyclic residues of a 3- to 30-membered ring, and n is 0 or 1.

8. An electrophotographic photosensitive material as set forth in claim 1, wherein the organic photoconductor is a compound represented by the following general formula (7a) or (7b):

signify a carbon, nitrogen, oxygen or sulfur atom, or, $R^7$ and $R^8$ are not included in the same ring and in this case $R^7$ and $R^8$ independently signify a hydrogen atom, an alkyl group having 1 to 12 carbon atoms, an aralkyl group having 7 to 14 carbon atoms, an aryl group having 6 to 20 carbon atoms or a heterocyclic residue of a 3- to 30-membered ring, (ii) in the case where $R^1$ and $R^2$ are not included in the same ring, $R^1$ is a hydrogen atom, $R^2$ and $R^3$ either form a ring together with the carbon atom to which $R^2$ and $R^3$ are bonded and in this case $R^2$ and $R^3$ independently signify a carbon, nitrogen, oxygen or sulfur atom, or, $R^2$ and $R^3$ are not included in the same ring and in this case $R^2$ and $R^3$ independently signify a hydrogen atom, an alkyl group having 1 to 12 carbon atoms, an aralkyl group having 7 to 14 carbon atoms, an aryl group having 6 to 20 carbon atoms, a heterocyclic residue of a 3- to 30-membered ring or

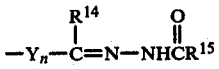

[where Y is a divalent group selected from an alkylene group having 1 to 12 carbon atoms, an aralkylene group having 7 to 14 carbon atoms, and an arylene group having 6 to 20 carbon atoms and a heterocyclic residue of a 3- to 30-membered ring, n is 0 or 1, $R^{14}$ is a hydrogen atom, an alkyl group having 1 to 12 carbon atoms, an aralkyl group having 7 to 14 carbon atoms, an aryl group having 6 to 20 carbon atoms or a heterocyclic residue of a 3- to 30-membered ring, and $R^{15}$ is an alkyl group having 1 to 12 carbon atoms, an aralkyl group having 7 to 14 carbon atoms, an aryl group having 6 to 20 carbon atoms or a heterocyclic residue of a 3- to 30-membered ring], X is

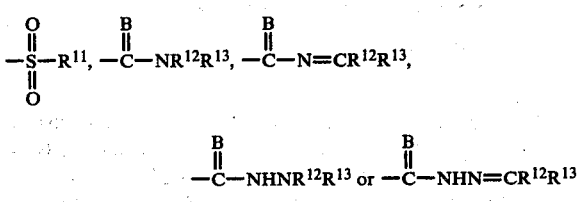

(where B is an oxygen atom or a sulfur atom, $R^{11}$ is an alkyl group having 1 to 12 carbon atoms, an aralkyl group having 7 to 14 carbon atoms, an aryl group having 6 to 20 carbon atoms or a heterocyclic residue of a 3- to 30-membered ring, $R^{12}$ and $R^{13}$ either form a ring together with the nitrogen or carbon atom to which $R^{12}$ and $R^{13}$ are bonded and in this case $R^{12}$ and $R^{13}$ independently signify a carbon, nitrogen, oxygen or sulfur atom, or, $R^{12}$ and $R^{13}$ are not included in the same ring and in this case $R^{12}$ and $R^{13}$ independently signify a hydrogen atom, an alkyl group having 1 to 12 carbon atoms, an aralkyl group having 7 to 14 carbon atoms, an aryl group having 6 to 20 carbon atoms, a heterocyclic residue of a 3- to 30-membered ring or

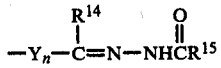

10 [where Y, n, $R^{14}$ and $R^{15}$ are the same as defined above]), $R^1$ through $R^{15}$ may be either substituted or not substituted.

2. An electrophotographic photosensitive material as set forth in claim 1, wherein the organic photoconductor is a compound represented by the following general formula (1a), (1b), or (1c):

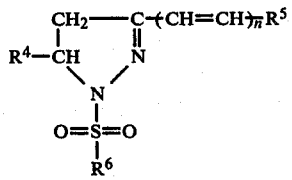

(1a)

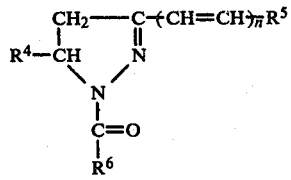

(1b)

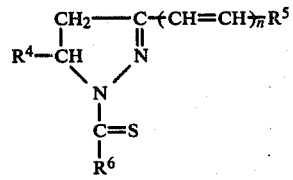

(1c)

wherein n is 0 or 1 and $R^4$, $R^5$ and $R^6$ indpendently signify an alkyl group having 1 to 12 carbon atoms, an aralkyl group having 7 to 14 carbon atoms, an aryl group having 6 to 20 carbon atoms or a heterocyclic residue of a 3- to 30-membered ring.

3. An electrphtographic photosensitive material as set forth in claim 1, wherein the organic photoconductor is a compound represented by the following general formula (2a) or (2b):

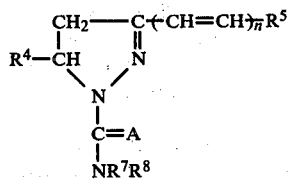

(2a)

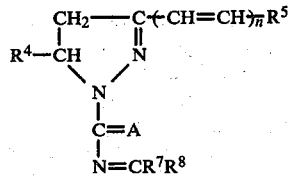

(2b)

wherein n is 0 or 1, $$R^{12}R^{13}N\overset{\overset{B}{\|}}{C}NHN{=}CR^2R^3 \quad (7a)$$

$$R^{12}R^{13}C{=}N\overset{\overset{B}{\|}}{C}NHN{=}CR^2R^3 \quad (7b)$$

wherein

B is an oxygen atom or a sulfur atom, and $R^2$ and $R^3$ either form a ring together with the carbon atom to which $R^2$ and $R^3$ are bonded and in this case $R^2$ and $R^3$ independently signify a carbon, nitrogen, oxygen or sulfur atom, or, $R^2$ and $R^3$ are not included in the same ring and in this case $R^2$ and $R^3$ independently signify a hydrogen atom, an alkyl group having 1 to 12 carbon atoms, an aralkyl group having 7 to 14 carbon atoms, an aryl group having 6 to 20 carbon atoms or a heterocyclic residue of a 3- to 30-memebered ring, and $R^{12}$ and $R^{13}$ are the same as the groups defined with respect to $R^2$ and $R^3$ above.

9. An electrophotographic photosensitive material as set forth in claim 1, wherein the organic photoconductor is a compound represented by the following general formula (8a) or (8b):

$$R^{13}R^{12}NNH\overset{\overset{B}{\|}}{C}NHN{=}CR^2R^3 \quad (8a)$$

$$R^{13}R^{12}C{=}NNH\overset{\overset{B}{\|}}{C}NHN{=}CR^2R^3 \quad (8b)$$

wherein

B is an oxygen atom or a sulfur atom, and $R^2$ and $R^3$ either form a ring together with the carbon atom to which $R^2$ and $R^3$ are bonded and in this case $R^2$ and $R^3$ independently signify a carbon, nitrogen, oxygen or sulfur atom, or, $R^2$ and $R^3$ are not included in the same ring and in this case $R^2$ and $R^3$ independently signify a hydrogen atom, an alkyl group having 1 to 12 carbon atoms, an aralkyl group having 7 to 14 carbon atoms, an aryl group having 6 to 20 carbon atoms or a heterocyclic residue of a 3- to 30-membered ring, and $R^{12}$ and $R^{13}$ are the same as those defined with respect to $R^2$ and $R^3$ above.

10. An electrophotographic photosensitive material as set forth in claim 1, wherein the polymeric binder is a member selected from the group consisting of polyamide-imides, polyesters, polyester-amides, polycarbonates, homopolymers and copolymers of acrylic acid esters and homopolymers and copolymers of methacrylic acid esters.

11. An electrophotographic photosensitive material as set forth in claim 1, wherein the photosensitive layer is a photoconductive layer or a charge transport layer.

12. An electrophotographic photosensitive material as set forth in claim 11, which has an electronductive substrate/photoconductive layer structure, an electroconductive substrate/charge generating layer/charge transport layer structure or an electroconductive substrate/charge transport layer/charge generating layer structure.

13. An electrophotographic photosensitive material as set forth in claim 11, which has a transparent electroconductive substrate/transparent photosensitive layer/-white dielectric layer structure.

14. An electrophotographic photosensitive material as set forth in claim 12, wherein each of the charge generating layers contains a charge generating material selected from the group consisting of bisazo pigments and phthalocyanine pigments.

* * * * *

UNITED STATES PATENT AND TRADEMARK OFFICE

CERTIFICATE OF CORRECTION

PATENT NO. : 4,463,077

DATED : July 31, 1984

INVENTOR(S) : Kazuo Matsuura and Keisuke Ohshima

It is certified that error appears in the above-identified patent and that said Letters Patent is hereby corrected as shown below:

Column 1, line 11, "photosensitive layer" should read --photosensitive material comprising a photosensitive layer-- line 26, delete the parenthesis before "including"

line 28, after "production" insert --)--

Column 2, line 37, "aralykyl" should read --aralkyl--

Column 3, line 48, "where" should read --[where-- line 48, "above)]" should read --above])

line 65, "ehtyl" should read --ethyl--

Column 4, line 1, "ehtylamino" should read --ethylamino--

Column 7, line 40, "ehtylamino" should read --ethylamino--

Column 9, line 42, "an an" should read --and an--

Column 19, line 65,

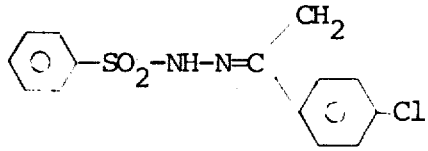

should read --

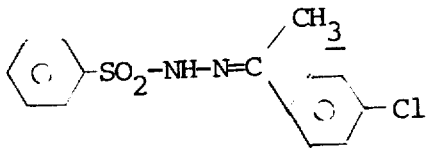

--

UNITED STATES PATENT AND TRADEMARK OFFICE

CERTIFICATE OF CORRECTION

PATENT NO. : 4,463,077

DATED : July 31, 1984

INVENTOR(S) : Kazuo Matsuura and Keisuke Ohshima

It is certified that error appears in the above-identified patent and that said Letters Patent is hereby corrected as shown below:

Column 25, line 50,

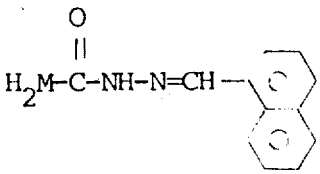

should read --

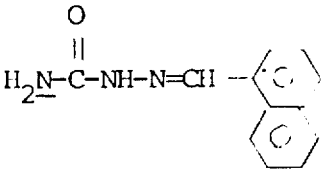

Column 35-36, Formula (8-33)

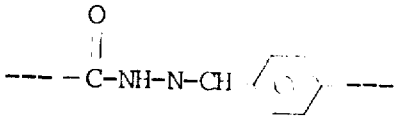

should read --

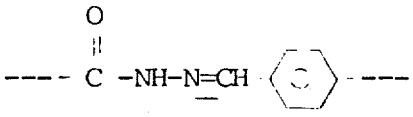

--

UNITED STATES PATENT AND TRADEMARK OFFICE

CERTIFICATE OF CORRECTION

PATENT NO. : 4,463,077

DATED : July 31, 1984

INVENTOR(S) : Kazuo Matsuura and Keisuke Ohshima

It is certified that error appears in the above-identified patent and that said Letters Patent is hereby corrected as shown below:

Column 36, line 63, "keton" should read --ketone--

Column 38, line 7, "Rphdamine" should read --Rhodamine--

Column 40, line 12, "phtosensitive" should read --photosensitive--

Column 43, line 13, "decaly" should read --decay--

Signed and Sealed this

*Fourteenth* Day of *May 1985*

[SEAL]

*Attest:*

DONALD J. QUIGG

*Attesting Officer*

*Acting Commissioner of Patents and Trademarks*